US011727912B1

(12) United States Patent
Rao et al.

(10) Patent No.: US 11,727,912 B1
(45) Date of Patent: Aug. 15, 2023

(54) DEEP ADAPTIVE ACOUSTIC ECHO CANCELLATION

(71) Applicant: Amazon Technologies, Inc., Seattle, WA (US)

(72) Inventors: Harsha Inna Kedage Rao, Campbell, CA (US); Srivatsan Kandadai, Danville, CA (US); Minje Kim, Bloomington, IN (US); Tarun Pruthi, Fremont, CA (US); Trausti Thor Kristjansson, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/707,125

(22) Filed: Mar. 29, 2022

(51) Int. Cl.
*G10K 11/178* (2006.01)
*G10K 11/175* (2006.01)

(52) U.S. Cl.
CPC .... *G10K 11/17854* (2018.01); *G10K 11/1754* (2020.05); *G10K 11/17823* (2018.01); *G10K 11/17825* (2018.01); *G10K 11/17881* (2018.01); *G10K 2210/3026* (2013.01); *G10K 2210/3027* (2013.01); *G10K 2210/3028* (2013.01); *G10K 2210/3038* (2013.01); *G10K 2210/505* (2013.01)

(58) Field of Classification Search
CPC ..... G10K 11/17854; G10K 11/17823; G10K 11/17825; G10K 11/17881; G10K 11/1754; G10K 2210/3026; G10K 2210/3027; G10K 2210/3028; G10K 2210/3038; G10K 2210/505
See application file for complete search history.

(56) References Cited

U.S. PATENT DOCUMENTS 10,839,786 B1 * 11/2020 Hera ..... H04R 5/04

* cited by examiner

*Primary Examiner* — Kile O Blair
(74) *Attorney, Agent, or Firm* — Pierce Atwood LLP

(57) ABSTRACT

A system configured to perform deep adaptive acoustic echo cancellation (AEC) to improve audio processing. Due to mechanical noise and continuous echo path changes caused by movement of a device, echo signals are nonlinear and time-varying and not fully canceled by linear AEC processing alone. To improve echo cancellation, deep adaptive AEC processing integrates a deep neural network (DNN) and linear adaptive filtering to perform echo and/or noise removal. The DNN is configured to generate a nonlinear reference signal and step-size data, which the linear adaptive filtering uses to generate output audio data representing local speech. The DNN may generate the nonlinear reference signal by generating mask data that is applied to a microphone signal, such that the reference signal corresponds to a portion of the microphone signal that does not include near-end speech.

20 Claims, 13 Drawing Sheets

$$\mu_{k,m} = f(Y_{k,m}, X_{k,m}) \qquad E_{k,m} = Y_{k,m} - \hat{W}^H_{k,m} X'_{k,m} \qquad Loss = MSE(E_{k,m}, T_{k,m})$$

$$X'_{k,m} = g(Y_{k,m}, X_{k,m}) \qquad \hat{W}_{k+1,m} = \hat{W}_{k,m} + \frac{\mu_{k,m}}{X'^H_{k,m} X'_{k,m} + \varepsilon} E^H_{k,m} X'_{k,m}$$

$$X'_{k,m} = |Y_{k,m}| \cdot M_{k,m} \cdot e^{j\theta_{Y_{k,m}}}$$

$$Y_{k,m} = S_{k,m} + D_{k,m} + N_{k,m}$$

DEEP ADAPTIVE ACOUSTIC ECHO CANCELLATION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture input audio and process input audio data. The input audio data may be used for voice commands and/or sent to a remote device as part of a communication session. If the device generates playback audio while capturing the input audio, the input audio data may include an echo signal representing a portion of the playback audio recaptured by the device.

To remove the echo signal, the device may perform acoustic echo cancellation (AEC) processing, but in some circumstances the AEC processing may not fully cancel the echo signal and an output of the echo cancellation may include residual echo. For example, due to mechanical noise and/or continuous echo path changes caused by movement of the device, the echo signal may be nonlinear and time-varying and linear AEC processing may be unable to fully cancel the echo signal.

To improve echo cancellation, devices, systems and methods are disclosed that perform deep adaptive AEC processing. For example, the deep adaptive AEC processing integrates a deep neural network (DNN) and linear adaptive filtering to perform either (i) echo removal or (ii) joint echo and noise removal. The DNN is configured to generate a nonlinear reference signal and step-size data, which the linear adaptive filtering uses to generate estimated echo data that accurately models the echo signal. For example, the step-size data may increase a rate of adaptation for an adaptive filter when local speech is not detected and may freeze adaptation of the adaptive filter when local speech is detected, causing the estimated echo data generated by the adaptive filter to correspond to the echo signal but not the local speech. By canceling the estimated echo data from a microphone signal, the deep adaptive AEC processing may generate output audio data representing the local speech. The DNN may generate the nonlinear reference signal by generating mask data that is applied to the microphone signal, such that the nonlinear reference signal corresponds to a portion of the microphone signal that does not include near-end speech.

Figure 1:
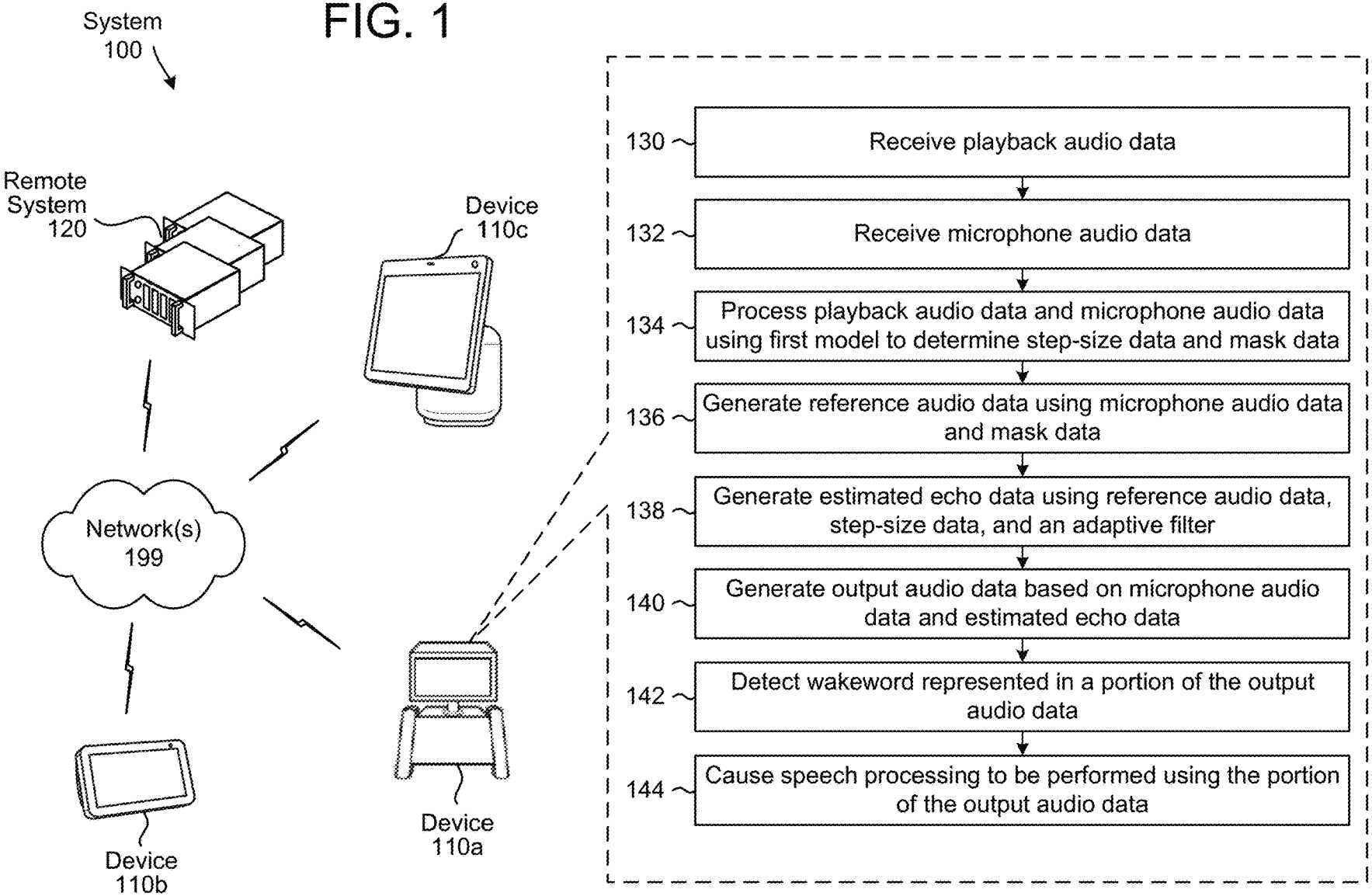
FIG. 1 is a conceptual diagram illustrating a system configured to perform deep adaptive acoustic echo cancellation processing according to embodiments of the present disclosure.

FIG. 1 is a conceptual diagram illustrating a system configured to perform deep adaptive acoustic echo cancellation processing according to embodiments of the present disclosure. As illustrated in FIG. 1, a system 100 may include multiple devices 110*a*/110*b*/110*c* connected across one or more networks 199. In some examples, the devices 110 (local to a user) may also be connected to a remote system 120 across the one or more networks 199, although the disclosure is not limited thereto.

The device 110 may be an electronic device configured to capture and/or receive audio data. For example, the device 110 may include a microphone array configured to generate microphone audio data that captures input audio, although the disclosure is not limited thereto and the device 110 may include multiple microphones without departing from the disclosure. As is known and used herein, "capturing" an audio signal and/or generating audio data includes a microphone transducing audio waves (e.g., sound waves) of captured sound to an electrical signal and a codec digitizing the signal to generate the microphone audio data. In addition to capturing the microphone audio data, the device 110 may be configured to receive playback audio data and generate output audio using one or more loudspeakers of the device 110. For example, the device 110 may generate output audio corresponding to media content, such as music, a movie, and/or the like.

If the device 110 generates playback audio while capturing the input audio, the microphone audio data may include an echo signal representing a portion of the playback audio recaptured by the device. In addition, the microphone audio data may include a speech signal corresponding to local speech, as well as acoustic noise in the environment, as shown below:

$$Y_{k,m}=S_{k,m}+D_{k,m}+N_{k,m} \quad [1]$$

where $Y_{k,m}$ denotes the microphone signal, $S_{k,m}$ denotes a speech signal (e.g., representation of local speech), $D_{k,m}$ denotes an echo signal (e.g., representation of the playback audio recaptured by the device 110), and $N_{k,m}$ denotes a noise signal (e.g., representation of acoustic noise captured by the device 110).

The device 110 may perform deep adaptive AEC processing to reduce or remove the echo signal $D_{k,m}$ and/or the noise signal $N_{k,m}$. For example, the device 110 may receive (130) playback audio data, may receive (132) microphone audio data, and may (134) process the playback audio data and the microphone audio data using a first model to determine step-size data and mask data. For example, the device 110 may include a deep neural network (DNN) configured to process the playback audio data and the microphone audio data to generate the step-size data and the mask data, as described in greater detail below with regard to FIG. 3.

The device 110 may then generate (136) reference audio data using the microphone audio data and the mask data. For example, the mask data may indicate portions of the microphone audio data that do not include the speech signal, such that the reference audio data corresponds to portions of the microphone audio data that represent the echo signal and/or the noise signal. The device 110 may generate (138) estimated echo data using the reference audio data, the step-size data, and an adaptive filter. For example, the device 110 may adapt the adaptive filter based on the step-size data, then use the adaptive filter to process the reference audio data and generate the estimated echo data. The estimated echo data may correspond to the echo signal and/or the noise signal without departing from the disclosure. In some examples, the step-size data may cause increased adaptation of the adaptive filter when local speech is not detected and may freeze adaptation of the adaptive filter when local speech is detected, although the disclosure is not limited thereto.

The device 110 may generate (140) output audio data based on the microphone audio data and the estimated echo data. For example, the device 110 may subtract the estimated echo data from the microphone audio data to generate the output audio data. In some examples, the device 110 may detect (142) a wakeword represented in a portion of the output audio data and may cause (144) speech processing to be performed using the portion of the output audio data. However, the disclosure is not limited thereto, and in other examples the device 110 may perform deep adaptive AEC processing during a communication session or the like, without detecting a wakeword or performing speech processing.

While FIG. 1 illustrates three separate devices 110*a*-110*c*, which may be in proximity to each other in an environment, this is intended to conceptually illustrate an example and the disclosure is not limited thereto. Instead, any number of devices may be present in the environment without departing from the disclosure. The device 110 may be speech-enabled, meaning that they are configured to perform voice commands generated by a user. The device 110 may perform deep adaptive AEC processing as part of detecting a voice command and/or as part of a communication session with another device 110 (or remote device not illustrated in FIG. 1) without departing from the disclosure.

An audio signal is a representation of sound and an electronic representation of an audio signal may be referred to as audio data, which may be analog and/or digital without departing from the disclosure. For ease of illustration, the disclosure may refer to either audio data (e.g., microphone audio data, input audio data, etc.) or audio signals (e.g., microphone audio signal, input audio signal, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, the audio data may correspond to audio signals in a time-domain. However, the disclosure is not limited thereto and the device 110 may convert these signals to a subband-domain or a frequency-domain prior to performing additional processing, such as adaptive feedback reduction (AFR) processing, acoustic echo cancellation (AEC), adaptive interference cancellation (AIC), noise reduction (NR) processing, tap detection, and/or the like. For example, the device 110 may convert the time-domain signal to the subband-domain by applying a bandpass filter or other filtering to select a portion of the time-domain signal within a desired frequency range. Additionally or alternatively, the device 110 may convert the time-domain signal to the frequency-domain using a Fast Fourier Transform (FFT) and/or the like.

As used herein, audio signals or audio data (e.g., microphone audio data, or the like) may correspond to a specific range of frequency bands. For example, the audio data may correspond to a human hearing range (e.g., 20 Hz-20 kHz), although the disclosure is not limited thereto.

As used herein, a frequency band (e.g., frequency bin) corresponds to a frequency range having a starting frequency and an ending frequency. Thus, the total frequency range may be divided into a fixed number (e.g., 256, 512, etc.) of frequency ranges, with each frequency range referred to as a frequency band and corresponding to a uniform size. However, the disclosure is not limited thereto and the size of the frequency band may vary without departing from the disclosure.

Figure 2A:
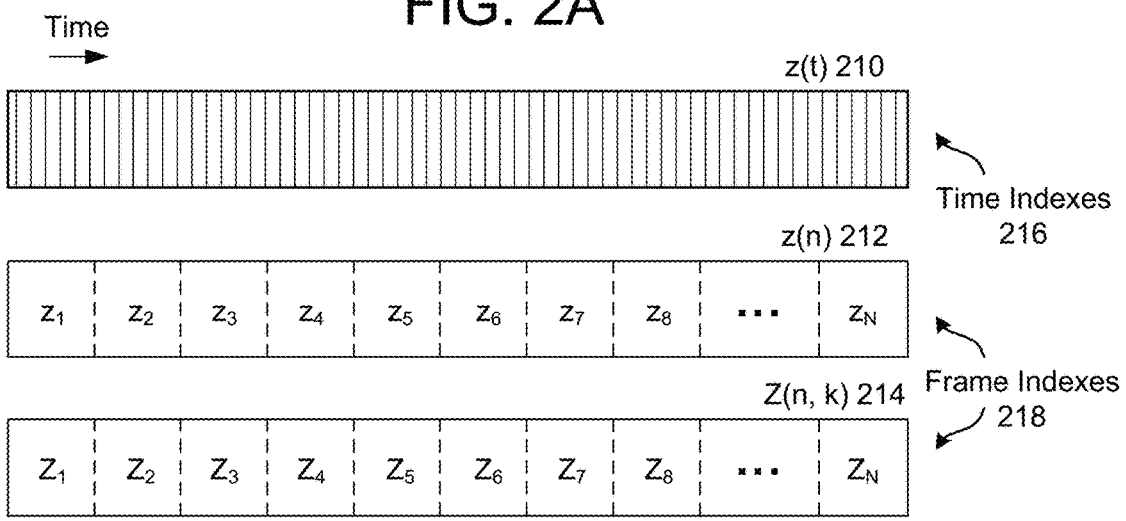
FIGS. 2A-2D illustrate examples of frame indexes, tone indexes, and channel indexes.

FIGS. 2A-2D illustrate examples of frame indexes, tone indexes, and channel indexes. As described above, the device 110 may generate microphone audio data z(t) using one or more microphone(s). For example, a first microphone may generate first microphone audio data $z_1(t)$ in the time-domain, a second microphone may generate second microphone audio data $z_2(t)$ in the time-domain, and so on. As illustrated in FIG. 2A, a time-domain signal may be represented as microphone audio data z(t) 210, which is comprised of a sequence of individual samples of audio data. Thus, z(t) denotes an individual sample that is associated with a time t.

While the microphone audio data z(t) 210 is comprised of a plurality of samples, in some examples the device 110 may group a plurality of samples and process them together. As illustrated in FIG. 2A, the device 110 may group a number of samples together in a frame to generate microphone audio data z(n) 212. As used herein, a variable z(n) corresponds to the time-domain signal and identifies an individual frame (e.g., fixed number of samples s) associated with a frame index n.

In some examples, the device 110 may convert microphone audio data z(t) 210 from the time-domain to the subband-domain. For example, the device 110 may use a plurality of bandpass filters to generate microphone audio data z(t, k) in the subband-domain, with an individual bandpass filter centered on a narrow frequency range. Thus, a first bandpass filter may output a first portion of the microphone audio data z(t) 210 as a first time-domain signal associated with a first subband (e.g., first frequency range), a second bandpass filter may output a second portion of the microphone audio data z(t) 210 as a time-domain signal associated with a second subband (e.g., second frequency range), and so on, such that the microphone audio data z(t, k) comprises a plurality of individual subband signals (e.g., subbands). As used herein, a variable z(t, k) corresponds to the subband-domain signal and identifies an individual sample associated with a particular time t and tone index k.

For ease of illustration, the previous description illustrates an example of converting microphone audio data z(t) 210 in the time-domain to microphone audio data z(t, k) in the subband-domain. However, the disclosure is not limited thereto, and the device 110 may convert microphone audio data z(n) 212 in the time-domain to microphone audio data z(n, k) the subband-domain without departing from the disclosure.

Additionally or alternatively, the device 110 may convert microphone audio data z(n) 212 from the time-domain to a frequency-domain. For example, the device 110 may perform Discrete Fourier Transforms (DFTs) (e.g., Fast Fourier transforms (FFTs), short-time Fourier Transforms (STFTs), and/or the like) to generate microphone audio data Z(n, k) 214 in the frequency-domain. As used herein, a variable Z(n, k) corresponds to the frequency-domain signal and identifies an individual frame associated with frame index n and tone index k. As illustrated in FIG. 2A, the microphone audio data z(t) 212 corresponds to time indexes 216, whereas the microphone audio data z(n) 212 and the microphone audio data Z(n, k) 214 corresponds to frame indexes 218.

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data Z(n). However, the disclosure is not limited thereto and the system 100 may instead perform short-time Fourier transform (STFT) operations without departing from the disclosure. A short-time Fourier transform is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency-domain representation of that same waveform comprises a plurality of discrete amplitude values, where each amplitude value is for a different tone or "bin." So, for example, if the sound wave consisted solely of a pure sinusoidal 1 kHz tone, then the frequency-domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., microphone audio data z(t) 210) and frame indexes 218 (e.g., microphone audio data z(n) 212 in the time-domain and microphone audio data Z(n, k) 216 in the frequency-domain). For example, the system 100 may apply FFT processing to the time-domain microphone audio data z(n) 212, producing the frequency-domain microphone audio data Z(n, k) 214, where the tone index "k" (e.g., frequency index) ranges from 0 to K and "n" is a frame index ranging from 0 to N. As illustrated in FIG. 2A, the history of the values across iterations is provided by the frame index "n", which ranges from 1 to N and represents a series of samples over time.

Figure 2B:
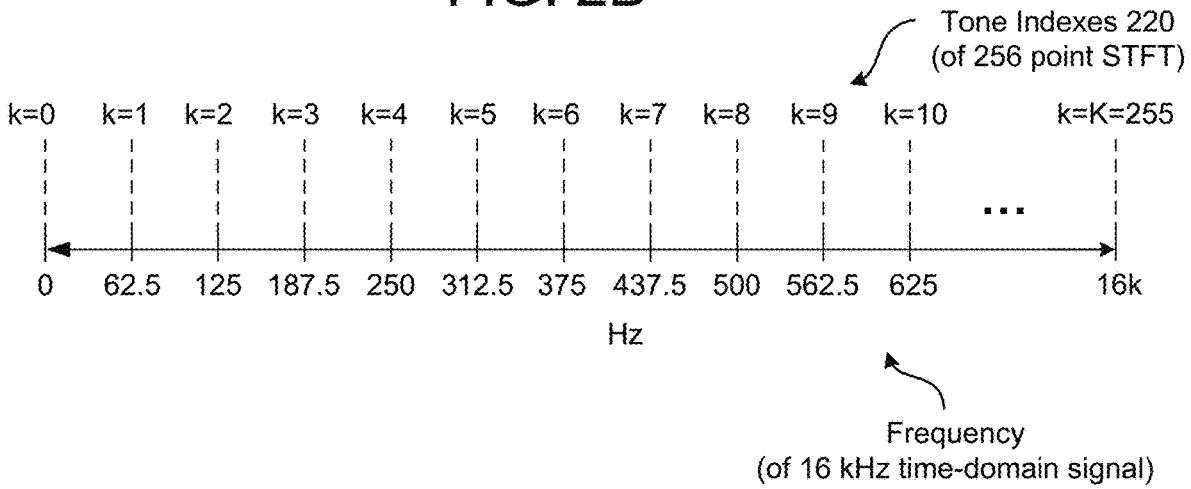

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 2B illustrates the frequency range being divided into 256 different frequency ranges (e.g., tone indexes), the disclosure is not limited thereto and the system 100 may divide the frequency range into K different frequency ranges (e.g., K indicates an FFT size). While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

Figure 2C:
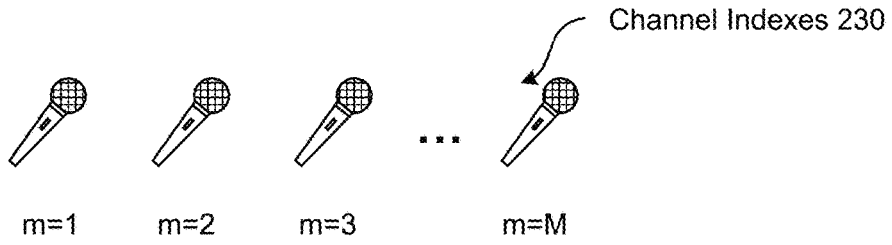

The system 100 may include multiple microphones, with a first channel m corresponding to a first microphone (e.g., m=1), a second channel (m+1) corresponding to a second microphone (e.g., m=2), and so on until a final channel (M) that corresponds to final microphone (e.g., m=M). FIG. 2C illustrates channel indexes 230 including a plurality of channels from channel m=1 to channel m=M. While an individual device 110 may include multiple microphones, during a communication session the device 110 may select a single microphone and generate microphone audio data using the single microphone. However, while many drawings illustrate a single channel (e.g., one microphone), the disclosure is not limited thereto and the number of channels may vary. For the purposes of discussion, an example of system 100 may include "M" microphones (M≥1) for hands free near-end/far-end distant speech recognition applications.

While FIGS. 2A-2D are described with reference to the microphone audio data z(t), the disclosure is not limited thereto and the same techniques apply to the playback audio data x(t) (e.g., reference audio data) without departing from the disclosure. Thus, playback audio data x(t) indicates a specific time index t from a series of samples in the time-domain, playback audio data x(n) indicates a specific frame index n from series of frames in the time-domain, and playback audio data X(n, k) indicates a specific frame index n and frequency index k from a series of frames in the frequency-domain.

Prior to converting the microphone audio data z(n) and the playback audio data x(n) to the frequency-domain, the device 110 may first perform time-alignment to align the playback audio data x(n) with the microphone audio data z(n). For example, due to nonlinearities and variable delays associated with sending the playback audio data x(n) to loudspeaker(s) using a wired and/or wireless connection, the playback audio data x(n) may not be synchronized with the microphone audio data z(n). This lack of synchronization may be due to a propagation delay (e.g., fixed time delay) between the playback audio data x(n) and the microphone audio data z(n), clock jitter and/or clock skew (e.g., difference in sampling frequencies between the device 110 and the loudspeaker(s)), dropped packets (e.g., missing samples), and/or other variable delays.

To perform the time alignment, the device 110 may adjust the playback audio data x(n) to match the microphone audio data z(n). For example, the device 110 may adjust an offset between the playback audio data x(n) and the microphone audio data z(n) (e.g., adjust for propagation delay), may add/subtract samples and/or frames from the playback audio data x(n) (e.g., adjust for drift), and/or the like. In some examples, the device 110 may modify both the microphone audio data z(n) and the playback audio data x(n) in order to synchronize the microphone audio data z(n) and the playback audio data x(n). However, performing nonlinear modifications to the microphone audio data z(n) results in first microphone audio data $z_1(n)$ associated with a first microphone to no longer be synchronized with second microphone audio data $z_2(n)$ associated with a second microphone. Thus, the device 110 may instead modify only the playback audio data x(n) so that the playback audio data x(n) is synchronized with the first microphone audio data $z_1(n)$.

While FIG. 2A illustrates the frame indexes 218 as a series of distinct audio frames, the disclosure is not limited thereto. In some examples, the device 110 may process overlapping audio frames and/or perform calculations using overlapping time windows without departing from the disclosure. For example, a first audio frame may overlap a second audio frame by a certain amount (e.g., 80%), such that variations between subsequent audio frames are reduced.

Additionally or alternatively, the first audio frame and the second audio frame may be distinct without overlapping, but the device 110 may determine power value calculations using overlapping audio frames. For example, a first power value calculation associated with the first audio frame may be calculated using a first portion of audio data (e.g., first audio frame and n previous audio frames) corresponding to a fixed time window, while a second power calculation associated with the second audio frame may be calculated using a second portion of the audio data (e.g., second audio frame, first audio frame, and n-1 previous audio frames) corresponding to the fixed time window. Thus, subsequent power calculations include n overlapping audio frames.

Figure 2D:
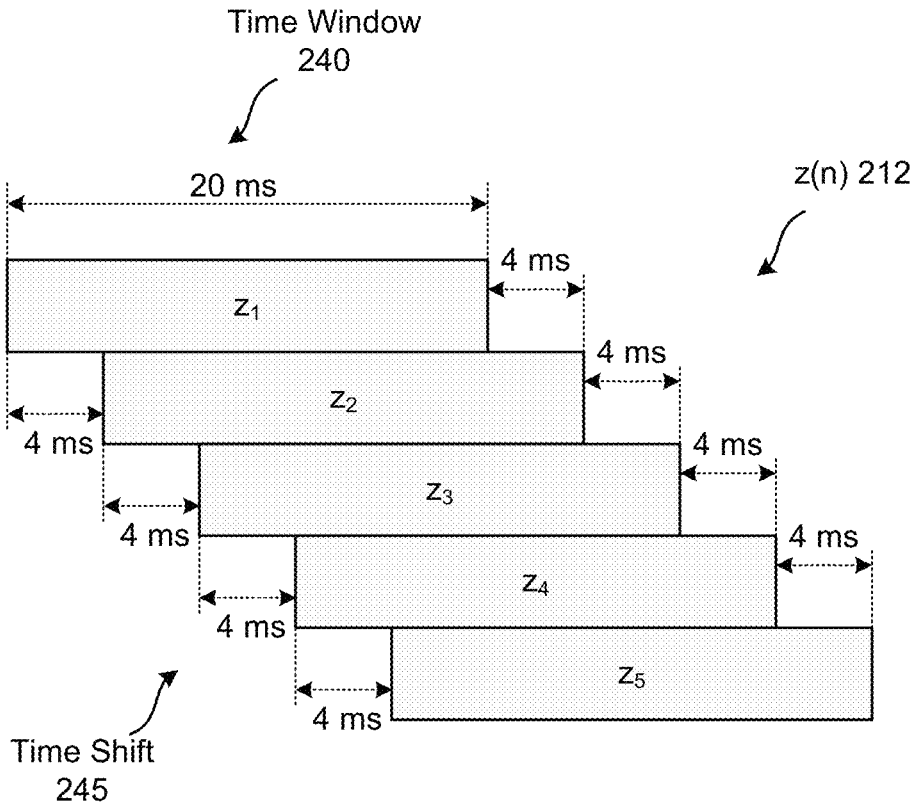

As illustrated in FIG. 2D, overlapping audio frames may be represented as overlapping audio data associated with a time window 240 (e.g., 20 ms) and a time shift 245 (e.g., 4 ms) between neighboring audio frames. For example, a first audio frame x1 may extend from 0 ms to 20 ms, a second audio frame x2 may extend from 4 ms to 24 ms, a third audio frame x3 may extend from 8 ms to 28 ms, and so on. Thus, the audio frames overlap by 80%, although the disclosure is not limited thereto and the time window 240 and the time shift 245 may vary without departing from the disclosure.

Figure 3:
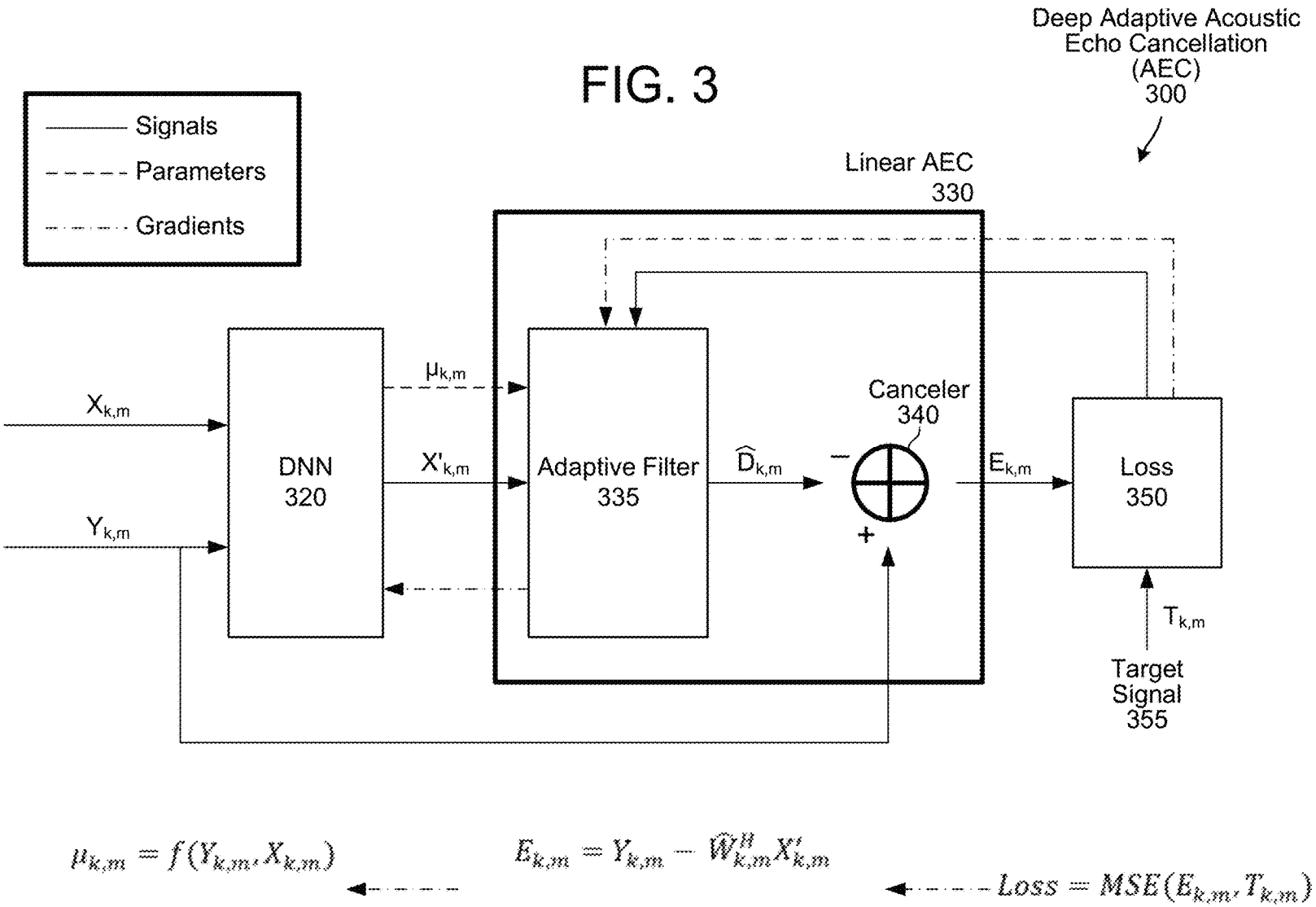
FIG. 3 illustrates an example component diagram for performing deep adaptive acoustic echo cancellation according to embodiments of the present disclosure.

FIG. 3 illustrates an example component diagram for performing deep adaptive acoustic echo cancellation according to embodiments of the present disclosure. As illustrated in FIG. 3, deep adaptive acoustic echo cancellation (AEC) processing 300 integrates deep learning with classic adaptive filtering, which improves performance for a nonlinear system, such as when an echo path changes continuously, and/or simplifies training of the system. For example, the deep adaptive AEC processing 300 illustrated in FIG. 3 combines a deep neural network (DNN) 320 with adaptive filtering, such as a linear AEC component 330. However, the disclosure is not limited thereto and the deep adaptive AEC processing 300 may include other output layers without departing from the disclosure. For example, while the following description refers to the linear AEC component 330 as corresponding to a least mean squares (LMS) filter, such as a normalized least mean squares (NLMS) filter configured to process first parameters (e.g., step-size data $\mu_{k,m}$ and reference signal $X'_{k,m}$) to generate an output signal (e.g., error signal $E_{k,m}$), the disclosure is not limited thereto. Instead, the deep adaptive AEC processing 300 may include other components, such as recursive least squares (RLS) component configured to process second parameters, a Kalman filter component configured to process third parameters, and/or the like without departing from the disclosure. Thus, depending on the specific implementation of the adaptive filtering, the DNN 320 may be configured to generate the second parameters and/or the third parameters without departing from the disclosure.

In some examples, the adaptive filtering algorithm may be represented as a differentiable layer within a DNN framework, enabling the gradients to flow through the adaptive layer during back propagation. Thus, inner layers of the DNN may be trained to estimate a playback reference signal and time-varying learning factors (e.g., step-size data) using a target signal as a ground truth.

As illustrated in FIG. 3, the DNN 320 may be configured to process a playback signal $X_{k,m}$ (e.g., far-end reference signal) and a microphone signal $Y_{k,m}$ to generate step-size data $\mu_{k,m}$ and a reference signal $X'_{k,m}$. As will be described in greater detail below with regard to FIG. 4 and FIGS. 8A-8D, in some examples the DNN 320 may be configured to generate the reference signal $X'_{k,m}$ indirectly without departing from the disclosure. For example, the DNN 320 may be configured to output the step-size data $\mu_{k,m}$ and mask data $M_{k,m}$ and then convert the mask data $M_{k,m}$ to the reference signal $X'_{k,m}$ without departing from the disclosure.

Figure 4:
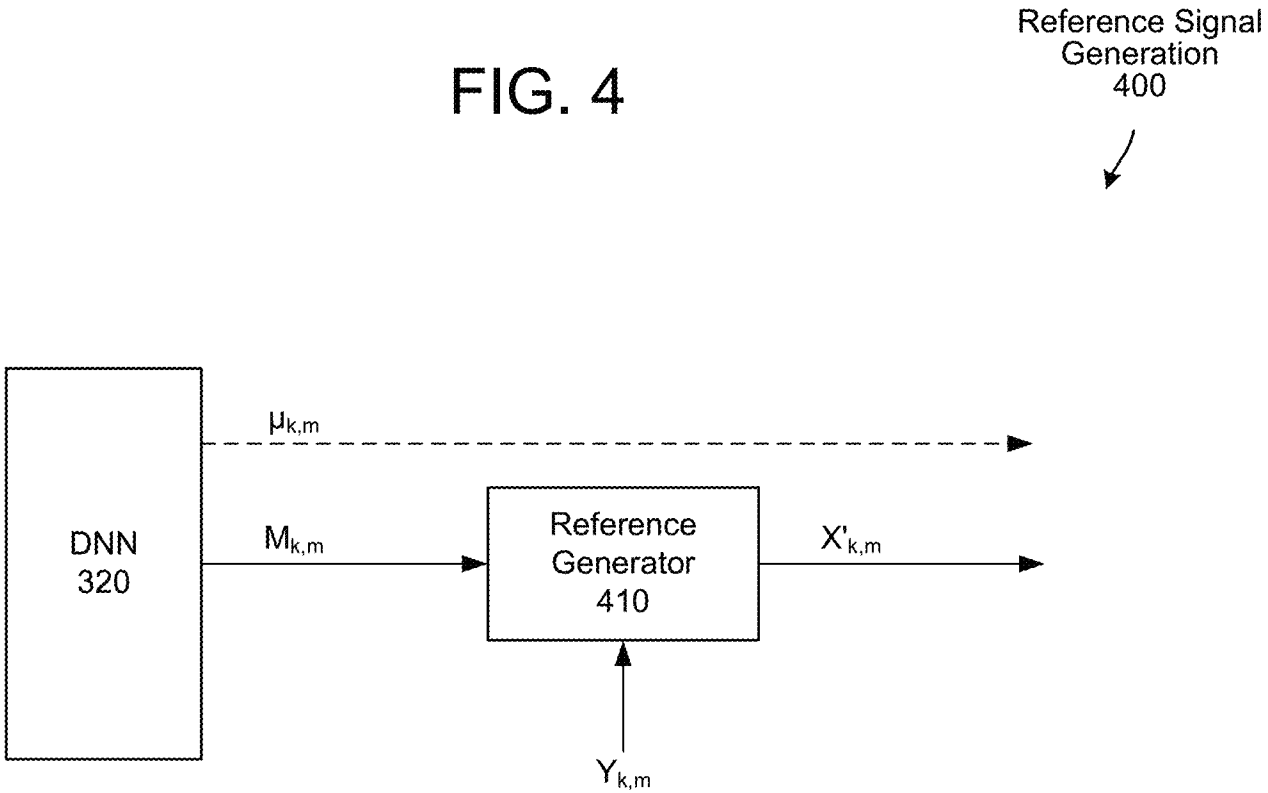
FIG. 4 illustrates an example component diagram for reference signal generation according to embodiments of the present disclosure.

FIG. 4 illustrates an example component diagram for reference signal generation according to embodiments of the present disclosure. As illustrated in FIG. 4, the DNN 320 may generate the step-size data $\mu_{k,m}$ and the mask data $M_{k,m}$, which corresponds to a mask that can be applied to the microphone signal $Y_{k,m}$ to generate the reference signal $X'_{k,m}$. For example, during reference signal generation 400 the DNN 320 may output the mask data $M_{k,m}$ to a reference generator component 410 and the reference generator component 410 may apply the mask data $M_{k,m}$ to the microphone signal $Y_{k,m}$ to generate the reference signal $X'_{k,m}$. As illustrated in FIG. 4, in some examples the reference generator component 410 may generate the reference signal $X'_{k,m}$ using the Equation shown below:

$$X'_{k,m} = |Y_{k,m}| \cdot M_{k,m} \cdot e^{j\theta_{Y_{k,m}}} \quad [2]$$

where $X'_{k,m}$ denotes the reference signal, $M_{k,m}$ denotes the mask data, $|Y_{k,m}|$and $\theta_{Y_{k,m}}$ denote the magnitude spectrogram and phase of the microphone signal $Y_{k,m}$, respectively, ·denotes point-wise multiplication, and j represents an imaginary unit. Thus, the reference signal $X'_{k,m}$ may correspond to a complex spectrogram without departing from the disclosure.

In the example illustrated in FIG. 4, the mask data $M_{k,m}$ may correspond to echo components (e.g., $D_{k,m}$) of the microphone signal $Y_{k,m}$, while masking speech components (e.g., $S_{k,m}$) of the microphone signal $Y_{k,m}$. As used herein, values of the mask data $M_{k,m}$ may range from a first value (e.g., 0) to a second value (e.g., 1), such that the mask data $M_{k,m}$ has a value range of [0, 1]. For example, the first value (e.g., 0) may indicate that a corresponding portion of the microphone signal $Y_{k,m}$ will be completely attenuated or ignored (e.g., masked), while the second value (e.g., 1) may indicate that a corresponding portion of the microphone signal $Y_{k,m}$ will be passed completely without attenuation. Thus, applying the mask data $M_{k,m}$ to the microphone signal $Y_{k,m}$ may remove at least a portion of the speech components (e.g., $S_{k,m}$) while leaving a majority of the echo components (e.g., $D_{k,m}$) in the reference signal $X'_{k,m}$.

Figure 6:
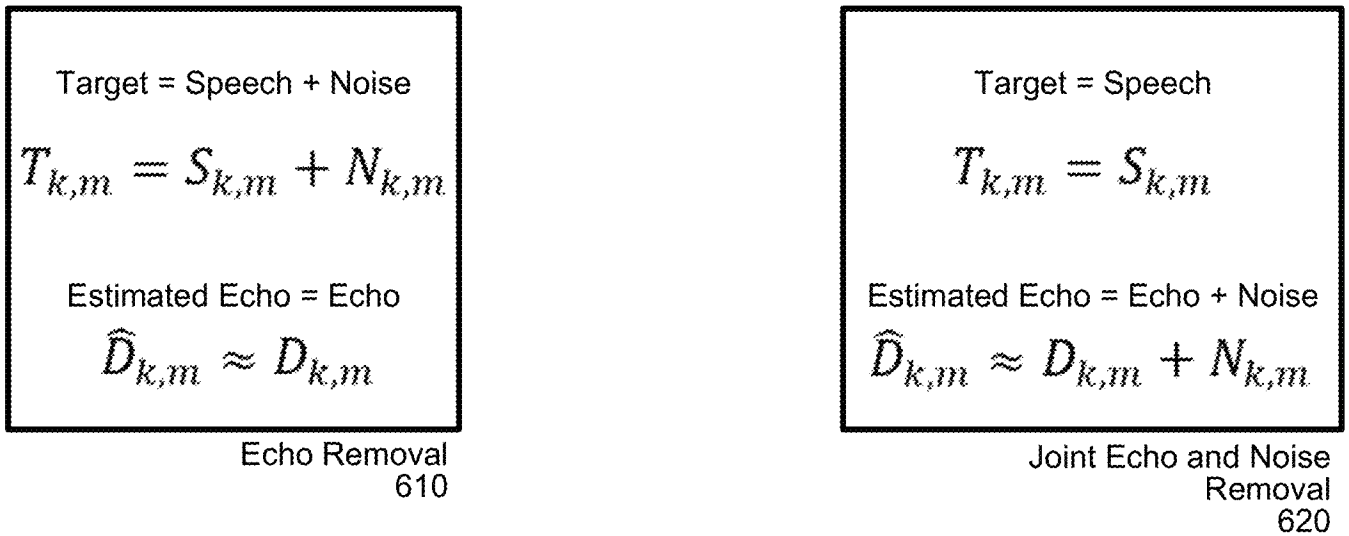
FIG. 6 illustrates examples of performing echo removal and joint echo and noise removal according to embodiments of the present disclosure.

In some examples, the reference signal $X'_{k,m}$ corresponds to only the echo components (e.g., $D_{k,m}$) and does not include near-end content (e.g., local speech and/or noise). However, the disclosure is not limited thereto, and in other examples the reference signal X'k,m may correspond to both the echo components (e.g., $D_{k,m}$) and the noise components (e.g., $N_{k,m}$) without departing from the disclosure. For example, FIG. 6 illustrates how the device 110 may either perform echo removal, such that the reference signal $X'_{k,m}$ only corresponds to the echo components (e.g., $D_{k,m}$), or perform joint echo and noise removal, such that the reference signal $X'_{k,m}$ corresponds to both the echo components (e.g., $D_{k,m}$) and the noise components (e.g., $N_{k,m}$).

As illustrated in FIG. 4, in some examples the DNN 320 may be configured to generate the mask data $M_{k,m}$ and additional logic (e.g., reference generator component 410), separate from the DNN 320, may use the mask data $M_{k,m}$ to generate the reference signal $X'_{k,m}$. However, the disclosure is not limited thereto and in other examples the DNN 320 (or a DNN framework that includes the DNN 320) may include a layer configured to convert the mask data $M_{k,m}$ to the reference signal $X'_{k,m}$ without departing from the disclosure. For ease of illustration, the DNN 320 may be illustrated as generating the mask data $M_{k,m}$ and/or the reference signal $X'_{k,m}$ without departing from the disclosure.

Figure 5:
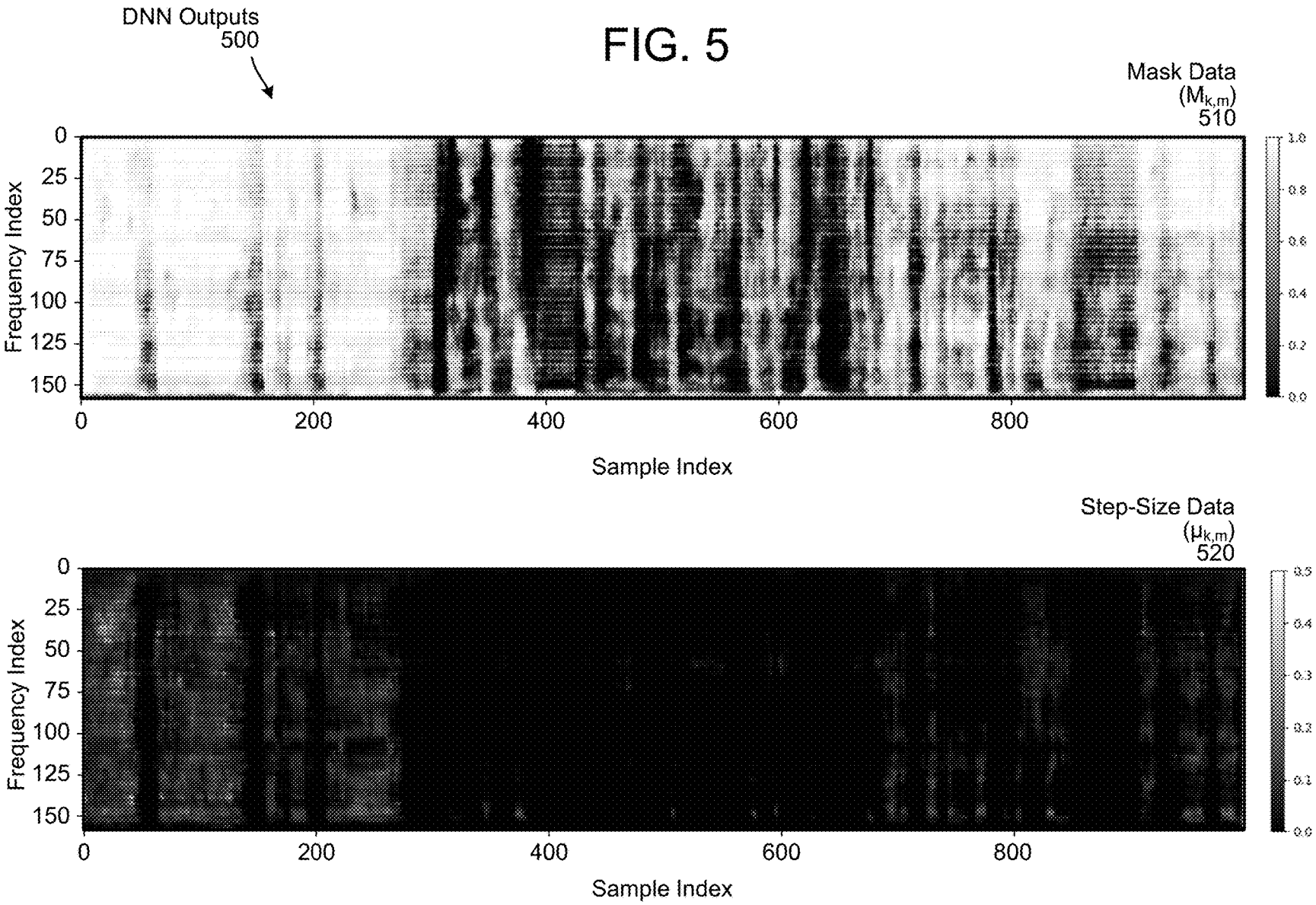
FIG. 5 illustrates examples of mask data and step-size data generated by the deep neural network according to embodiments of the present disclosure.

FIG. 5 illustrates examples of mask data and step-size data generated by the deep neural network according to embodiments of the present disclosure. As described above, in some examples the DNN 320 may generate DNN outputs 500, such as mask data $M_{k,m}$ and/or step-size data $\mu_{k,m}$, which may be used by the linear AEC component 330 to perform echo cancellation. To conceptually illustrate example DNN outputs 500, FIG. 5 includes an example of mask data $M_{k,m}$ 510 (e.g., a predicted mask) and an example of step-size data $\mu_{k,m}$ 520, although the disclosure is not limited thereto.

As described above, values of the mask data $M_{k,m}$ may range from a first value (e.g., 0) to a second value (e.g., 1), such that the mask data $M_{k,m}$ has a value range of [0, 1]. For example, the first value (e.g., 0) may indicate that a corresponding portion of the microphone signal $Y_{k,m}$ will be completely attenuated or ignored (e.g., masked), while the second value (e.g., 1) may indicate that a corresponding portion of the microphone signal $Y_{k,m}$ will be passed completely without attenuation. Thus, applying the mask data $M_{k,m}$ to the microphone signal $Y_{k,m}$ may remove at least a portion of the speech components (e.g., $S_{k,m}$) while leaving a majority of the echo components (e.g., $D_{k,m}$) in the reference signal $X'_{k,m}$.

In the example mask data $M_{k,m}$ 510 illustrated in FIG. 5, the horizontal axis corresponds to time (e.g., sample index), the vertical axis corresponds to frequency (e.g., frequency index), and an intensity of the mask data $M_{k,m}$ 510 for each time-frequency unit is represented using a range of color values, as shown in the legend. For example, the mask data $M_{k,m}$ 510 represents the first value (e.g., 0) as black, the second value (e.g., 1) as dark gray, and all of the intensity values between the first value and the second value as varying shades of gray. Thus, the mask data $M_{k,m}$ 510 may correspond to audio data that has three discrete segments, with a first segment (e.g., audio frames 0-300) corresponding to echo signals and/or noise signals without speech components (e.g., mask values above 0.8), a second segment (e.g., audio frames 300-700) corresponding to continuous echo signals combined with strong speech signals (e.g., mask values split between a first range from 0.5 to 0.8 and a second range from 0.0 to 0.4), and a third segment (e.g., audio frames 700-1000) corresponding to a mix of echo signals and weak speech signals (e.g., mask values in a range from 0.4 to 0.8).

Similarly, values of the step-size data $\mu_{k,m}$ may range from the first value (e.g., 0) to the second value (e.g., 1), such that the step-size data $\mu_{k,m}$ has a value range of [0, 1]. However, while the mask data $M_{k,m}$ corresponds to an intensity of the mask (e.g., mask value indicates an amount of attenuation to apply to the microphone signal $Y_{k,m}$), the step-size data $\mu_{k,m}$ corresponds to an amount of adaptation to perform by the adaptive filter (e.g., how quickly the adaptive filter modifies adaptive filter coefficients). For example, the first value (e.g., 0) may correspond to performing a small amount of adaptation and/or freezing the adaptive coefficient values of the adaptive filter, whereas the second value (e.g., 1) may correspond to a large amount of adaptation and/or rapidly modifying the adaptive coefficient values.

In the example step-size data $\mu_{k,m}$ 520 illustrated in FIG. 5, the horizontal axis corresponds to time (e.g., sample index), the vertical axis corresponds to frequency (e.g., frequency index), and an intensity of the step-size data $\mu_{k,m}$ 520 for each time-frequency unit is represented using a range of color values, as shown in the legend. For example, the step-size data $\mu_{k,m}$ 520 represents the first value (e.g., 0) as black, the second value (e.g., 1) as dark gray, and all of the intensity values between the first value and the second value as varying shades of gray.

In practice, the values of the example step-size data $\mu_{k,m}$ 520 illustrated in FIG. 5 range from the first value (e.g., 0) to a third value (e.g., 0.25), which is only a fraction of the second value in order to control the rate of adaptation. To illustrate an example, the step-size data $\mu_{k,m}$ corresponds to higher values (e.g., faster adaptation) when there are only echo components and/or noise components represented in the microphone signal $Y_{k,m}$, which occurs during the first segment and the third segment. This enables the linear AEC component 330 to quickly adapt the adaptive filter coefficients and converge the system so that the estimated echo signal cancels out a majority of the microphone signal $Y_{k,m}$. In contrast, the step-size data $\mu_{k,m}$ corresponds to lower values (e.g., slower adaptation) when speech components are represented in the microphone signal $Y_{k,m}$ along with the echo components and/or the noise components, which occurs during the second segment. This enables the linear AEC component 330 to freeze the adaptive filter coefficients generated based on the echo components and continue performing echo cancellation without adapting to remove the speech components.

Referring back to FIG. 3, during deep adaptive AEC processing 300 the DNN 320 may generate the step-size data $\mu_{k,m}$ and the reference signal $X'_{k,m}$, as shown below:

$$\mu_{k,m}=f(Y_{k,m}, X_{k,m}) \quad [3]$$

$$X'_{k,m}=g(Y_{k,m}, X_{k,m}) \quad [4]$$

where $f(\cdot)$ and $g(\cdot)$ represent the nonlinear transform functions learned by the DNN 320 for estimating the step-size data $\mu_{k,m}$ and the reference signal $X'_{k,m}$, respectively. The DNN 320 may output the step-size data $\mu_{k,m}$ and the reference signal $X'_{k,m}$ to the linear AEC component 330.

In certain aspects, an AEC component may be configured to receive the playback signal $X_{k,m}$ and generate an estimated echo signal based on the playback signal $X_{k,m}$ itself (e.g., by applying adaptive filters to the playback signal $X_{k,m}$ to model the acoustic echo path). However, this models the estimated echo signal using a linear system, which suffers from degraded performance when nonlinear and time-varying echo signals and/or noise signals are present. For example, the linear system may be unable to model echo signals that vary based on how the echo signals reflect from walls and other acoustically reflective surfaces in the environment as the device 110 is moving.

To improve performance even when nonlinear and time-varying echo signals and/or noise signals are present, the linear AEC component 330 performs echo cancellation using the nonlinear reference signal $X'_{k,m}$ generated by the DNN 320. Thus, instead of estimating the real acoustic echo path, the linear AEC component 330 may be configured to estimate a transfer function between the estimated nonlinear reference signal $X'_{k,m}$ and the echo signal $D_{k,m}$.

As illustrated in FIG. 3, the linear AEC component 330 may receive the step-size data $\mu_{k,m}$ and the reference signal $X'_{k,m}$ and may generate an estimated echo signal $\hat{D}_{k,m}$. corresponding to the echo signal $D_{k,m}$. For example, the linear AEC component 330 may perform echo removal by updating an adaptive filter 335 to estimate the transfer function denoted by $\hat{W}_{k,m}$. A canceler component 340 may then subtract the estimated echo signal $\hat{D}_{k,m}$ from the microphone signal $Y_{k,m}$ to generate the system output (e.g., error signal) $E_{k,m}$, as shown below:

$$E_{k,m} = Y_{k,m} - \hat{D}_{k,m},\ \hat{D}_{k,m} = \hat{W}^H_{k,m} X'_{k,m} \quad [5]$$

$$\hat{W}_{k+1,m} = \hat{W}_{k,m} + \frac{\mu_{k,m}}{X'^H_{k,m} X'_{k,m} + \varepsilon} E^H_{k,m} X'_{k,m} \quad [6]$$

where $E_{k,m}$ denotes the Error Signal, $Y_{k,m}$ denotes the microphone signal, $\hat{D}_{k,m}$ denotes the estimated echo signal, $X'_{k,m}$ denotes the reference signal, $\hat{W}_{k,m}$ denotes an adaptive filter of length L, $\mu_{k,m}$ denotes the step-size, $\epsilon$ denotes a regularization parameter, and the superscript$^H$ represents conjugate transpose. In some examples, the linear AEC component 330 may be implemented as a differentiable layer with no trainable parameters, enabling gradients to flow through it and train the DNN parameters associated with the DNN 320.

As described above, the step-size data $\mu_{k,m}$ determines the learning rate of the adaptive filter and therefore needs to be chosen carefully to guarantee the convergence of the system and achieve acceptable echo removal. The deep adaptive AEC processing 300 improves echo removal by training the DNN 320 to generate the step-size data $\mu_{k,m}$ based on both the reference signal X'k,m and the microphone signal $Y_{k,m}$, such that the step-size data $\mu_{k,m}$ (i) increases adaptation when the speech components are not present in the microphone signal $Y_{k,m}$ and (ii) freezes and/or slows adaptation when speech components are present in the microphone signal $Y_{k,m}$. In addition, the deep adaptive AEC processing 300 improves echo removal by training the DNN 320 to generate the nonlinear reference signal $X'_{k,m}$.

After the adaptive filter 335 uses the step-size data $\mu_{k,m}$ and the reference signal $X'_{k,m}$ to generate the estimated echo signal $\hat{D}_{k,m}$, the canceler component 340 may subtract the estimated echo signal $\hat{D}_{k,m}$ from the microphone signal $Y_{k,m}$ to generate the error signal $E_{k,m}$. While FIG. 3 illustrates the linear AEC component 330 as including the adaptive filter 335 and the canceler component 340 as separate components, the disclosure is not limited thereto and a single component (e.g., linear AEC component 330) may be configured to perform the functionality of the adaptive filter 335 and the canceler component 340 without departing from the disclosure.

Using the adaptive filter 335 and/or the canceler component 340, the linear AEC component 330 may generate the estimated echo signal $\hat{D}_{k,m}$ and remove the estimated echo signal $\hat{D}_{k,m}$ from the microphone signal $Y_{k,m}$ to generate the error signal $E_{k,m}$. Thus, if the estimated echo signal $\hat{D}_{k,m}$ corresponds to a representation of the echo signal $D_{k,m}$, the device 110 effectively cancels the echo signal $D_{k,m}$, such that the error signal $E_{k,m}$ includes a representation of the speech signal $S_{k,m}$ without residual echo. However, if the estimated echo signal $\hat{D}_{k,m}$ does not accurately correspond to a representation of the echo signal $D_{k,m}$, the device 110 may only cancel a portion of the echo signal $D_{k,m}$, such that the error signal $E_{k,m}$ includes a representation of the speech signal $S_{k,m}$ along with a varying amount of residual echo. The residual echo may depend on several factors, such as distance(s) between loudspeaker(s) and microphone(s), a Signal to Echo Ratio (SER) value of the input to the AFE component, loudspeaker distortions, echo path changes, convergence/tracking speed, and/or the like, although the disclosure is not limited thereto.

As illustrated in FIG. 3, during training the device 110 may train the DNN 320 using a loss function 350 associated with the error signal $E_{k,m}$. For example, the device 110 may use a target signal $T_{k,m}$ 355 as a ground truth and may compare the error signal $E_{k,m}$ to the target signal $T_{k,m}$ 355 to train the DNN 320, as shown below:

$$\text{Loss}=MSE(E_{k,m}T_{k,m}) \quad [7]$$

where Loss denotes the loss function 350, $E_{k,m}$ denotes the error signal, $T_{k,m}$ denotes the target signal 355, and MSE denotes the mean squared error between the error signal $E_{k,m}$ and the target signal $T_{k,m}$. In some examples, the device 110 may perform echo removal, such that the estimated echo signal $\hat{D}_{k,m}$ corresponds to the echo components (e.g., $D_{k,m}$). However, the disclosure is not limited thereto, and in other examples the device 110 may perform joint echo and noise removal, such that the estimated echo signal $\hat{D}_{k,m}$ corresponds to both the echo components (e.g., $D_{k,m}$) and the noise components (e.g., $N_{k,m}$). While FIG. 3 illustrates an example in which the loss function is solved based on the mean squared error (MSE), the disclosure is not limited thereto and the loss function may use other operations without departing from the disclosure.

FIG. 6 illustrates examples of performing echo removal and joint echo and noise removal according to embodiments of the present disclosure. As illustrated in FIG. 6, in some examples the device 110 may perform echo removal 610, such that the target signal $T_{k,m}$ 355 corresponds to both the speech components (e.g., $S_{k,m}$) and the noise components (e.g., $N_{k,m}$). As a result, the estimated echo signal $\hat{D}_{k,m}$ corresponds to the echo components (e.g., $D_{k,m}$), as shown below:

$$T_{k,m}=S_{k,m}+N_{k,m} \quad [8a]$$

$$\hat{D}_{k,m}\approx D_{k,m} \quad [8b]$$

where $T_{k,m}$ denotes the target signal, $S_{k,m}$ denotes the speech signal (e.g., representation of local speech), $N_{k,m}$ denotes the noise signal (e.g., representation of acoustic noise captured by the device 110, $\hat{D}_{k,m}$ denotes the estimated echo signal generated by the linear AEC component 330, and $D_{k,m}$ denotes the echo signal (e.g., representation of the playback audio recaptured by the device 110). Training the model using this target signal $T_{k,m}$ focuses on echo removal without performing noise reduction, and the estimated echo signal $\hat{D}_{k,m}$ approximates the echo signal $D_{k,m}$.

In contrast, in other examples the device 110 may perform joint echo and noise removal 620, such that the target signal $T_{k,m}$ 355 corresponds to only the speech components (e.g., $S_{k,m}$). As a result, the estimated echo signal $\hat{D}_{k,m}$ corresponds to both the echo components (e.g., $D_{k,m}$) and the noise components (e.g., $N_{k,m}$), as shown below:

$$T_{k,m}=S_{k,m} \quad [9a]$$

$$D_{k,m}\approx D_{k,m}+N_{k,m} \quad [9b]$$

Thus, the estimated echo signal $D_{k,m}$ may correspond to (i) the echo signal $D_{k,m}$ during echo removal 610 or (ii) a combination of the echo signal $D_{k,m}$ and the noise signal $N_{k,m}$ during joint echo and noise removal 620. Training the model using this target signal $T_{k,m}$ achieves joint echo and noise removal, and the estimated echo signal $\hat{D}_{k,m}$ approximates a combination of the echo signal $D_{k,m}$ and the noise signal $N_{k,m}$ (e.g., background noise). Therefore, the error signal $E_{k,m}$ corresponds to an estimate of the speech signal $S_{k,m}$ (e.g., near end speech) with the echo and noise jointly removed from the microphone signal $Y_{k,m}$.

Referring back to FIG. 3, the loss function 350 is separated from the DNN 320 by the linear AEC component 330. In the deep adaptive AEC processing 300 illustrated in FIG. 3, gradients flow from the loss function 350 to the linear AEC component 330 and from the linear AEC component 330 to the DNN 320 during back propagation. Thus, the linear AEC component 330 acts as a differentiable signal processing layer within a DNN framework, enabling the loss function 350 to be back propagated to the DNN 320.

While the linear AEC component 330 corresponds to a differentiable signal processing layer, enabling back propagation from the loss function 350 to the DNN 320, the deep adaptive AEC processing 300 does not train the DNN 320 using ground truths for the step-size data $\mu_{k,m}$ or the reference signal $X'_{k,m}$. For example, in a simple system including only the DNN 320, the DNN 320 may be trained by inputting a first portion of training data (e.g., a training playback signal and a training microphone signal) to the DNN 320 to generate the step-size data $\mu_{k,m}$ and the reference signal $X'_{k,m}$, and then comparing the step-size data $\mu_{k,m}$ and the reference signal $X'_{k,m}$ output by the DNN 320 to a second portion of the training data (e.g., known values for the step-size and the reference signal). Thus, the second portion of the training data would correspond to step-size values and reference signal values that act as a ground truth by which to train the DNN 320.

In contrast, the deep adaptive AEC processing 300 trains the DNN 320 using the loss function 350 with the target signal $T_{k,m}$ 355 as a ground truth. For example, the device 110 may train the DNN 320 by inputting a first portion of training data (e.g., a training playback signal and a training microphone signal) to the DNN 320 to generate the step-size data $\mu_{k,m}$ and the reference signal $X'_{k,m}$, processing the step-size data $X'_{k,m}$ and the reference signal $X'_{k,m}$ to generate the error signal $E_{k,m}$, and then comparing the error signal $E_{k,m}$ to a second portion of the training data (e.g., known values for the target signal $T_{k,m}$ 355). Thus, the second portion of the training data would correspond to the target signal $T_{k,m}$ 355 that acts as a ground truth by which to train the DNN 320. During the inference stage, the parameters of the DNN 320 are fixed while the linear AEC component 330 is updating its filter coefficients adaptively using the step-size data $\mu_{k,m}$ and the reference signal $X'_{k,m}$.

The combination of the DNN 320 and the linear AEC component 330 improves the deep adaptive AEC processing 300 in multiple ways. For example, the DNN 320 may compensate for nonlinear and time-varying distortions and generate a nonlinear reference signal $X'_{k,m}$. Between the nonlinear reference signal $X'_{k,m}$ and training the DNN 320 to design appropriate time-frequency dependent step-size values, the linear AEC component 330 is equipped to model echo path variations. Thus, from a signal processing perspective, the deep adaptive AEC processing 300 can be interpreted as an adaptive AEC with its reference signal and step-size estimated by the DNN 320. From a deep learning perspective, the linear AEC component 330 can be interpreted as a non-trainable layer within a DNN framework. Integrating this interpretable and more constrained linear AEC elements into the more general and expressive DNN framework encodes structural knowledge in the model and makes model training easier.

In some examples, the device 110 may generate the training data used to train the DNN 320 by separately generating a speech signal (e.g., $S_{k,m}$), an echo signal (e.g., $D_{k,m}$), and a noise signal (e.g., $N_{k,m}$). For example, the echo signal may be generated by outputting playback audio and recording actual echoes of the playback audio by generating first audio data using a mobile platform. This echo signal may be combined with second audio data representing speech (e.g., an utterance) and third audio data representing noise to generate the microphone signal $Y_{k,m}$. Thus, the microphone signal $Y_{k,m}$ corresponds to a digital combination of the first audio data, the second audio data, and the third audio data, and the device 110 may select the target signal $T_{k,m}$ 355 as either the second audio data and the third audio data (e.g., echo removal) or just the second audio data (e.g., joint echo and noise removal), although the disclosure is not limited thereto.

While FIGS. 3-6 illustrate examples in which the device 110 performs deep adaptive AEC processing 300 using a linear AEC component 330, the disclosure is not limited thereto. Instead, the deep adaptive AEC processing 300 may combine the deep neural network (DNN) 320 with other adaptive filtering components without departing from the disclosure. For example, while the previous description refers to the linear AEC component 330 as corresponding to a least mean squares (LMS) filter, such as a normalized least mean squares (NLMS) filter configured to process first parameters (e.g., step-size data $\mu_{k,m}$ and reference signal $X'_{k,m}$) to generate an output signal (e.g., error signal $E_{k,m}$), the disclosure is not limited thereto. Instead, the deep adaptive AEC processing 300 may include other components, such as recursive least squares (RLS) component configured to process second parameters, a Kalman filter component configured to process third parameters, and/or the like without departing from the disclosure. Thus, depending on the specific implementation of the adaptive filtering, the DNN 320 may be configured to generate the second parameters and/or the third parameters without departing from the disclosure.

Figure 7:
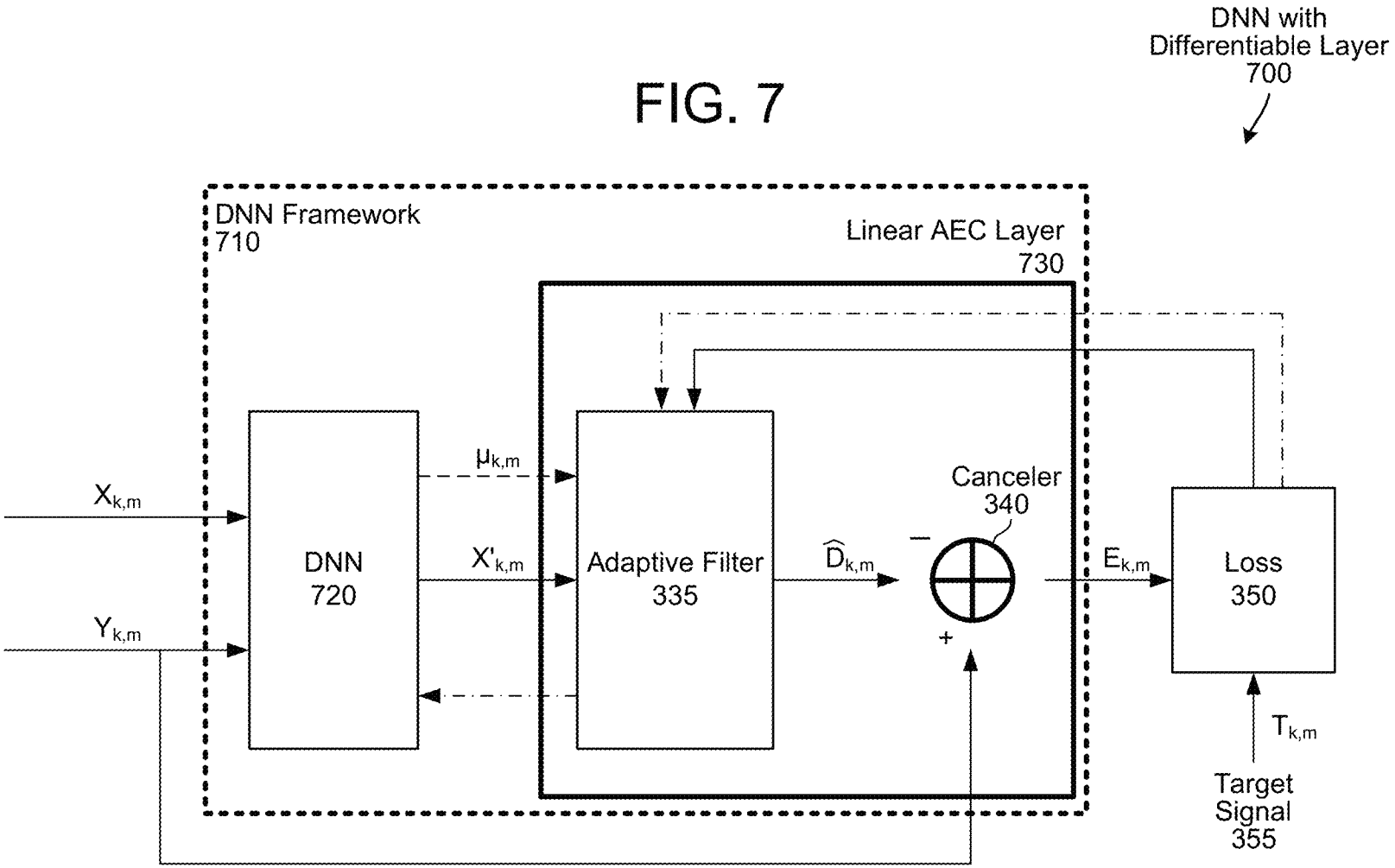
FIG. 7 illustrates an example component diagram of a deep neural network with a differentiable layer according to embodiments of the present disclosure.

FIG. 7 illustrates an example component diagram of a deep neural network with a differentiable layer according to embodiments of the present disclosure. As described above, the deep adaptive AEC processing can be illustrated with the linear AEC represented as a differentiable signal processing layer within a DNN framework. An example of a DNN with a differentiable layer 700 is illustrated in FIG. 7, which shows a DNN framework 710 including a DNN 720 and a linear AEC layer 730, which may be a single layer that performs the functionality described above with regard to the adaptive filter 335 and the canceler 340. Thus, the DNN framework 710 may perform the functionality described above with regard to the deep adaptive AEC processing 300 by including additional non-trainable layer(s), although the disclosure is not limited thereto.

Figure 8B:
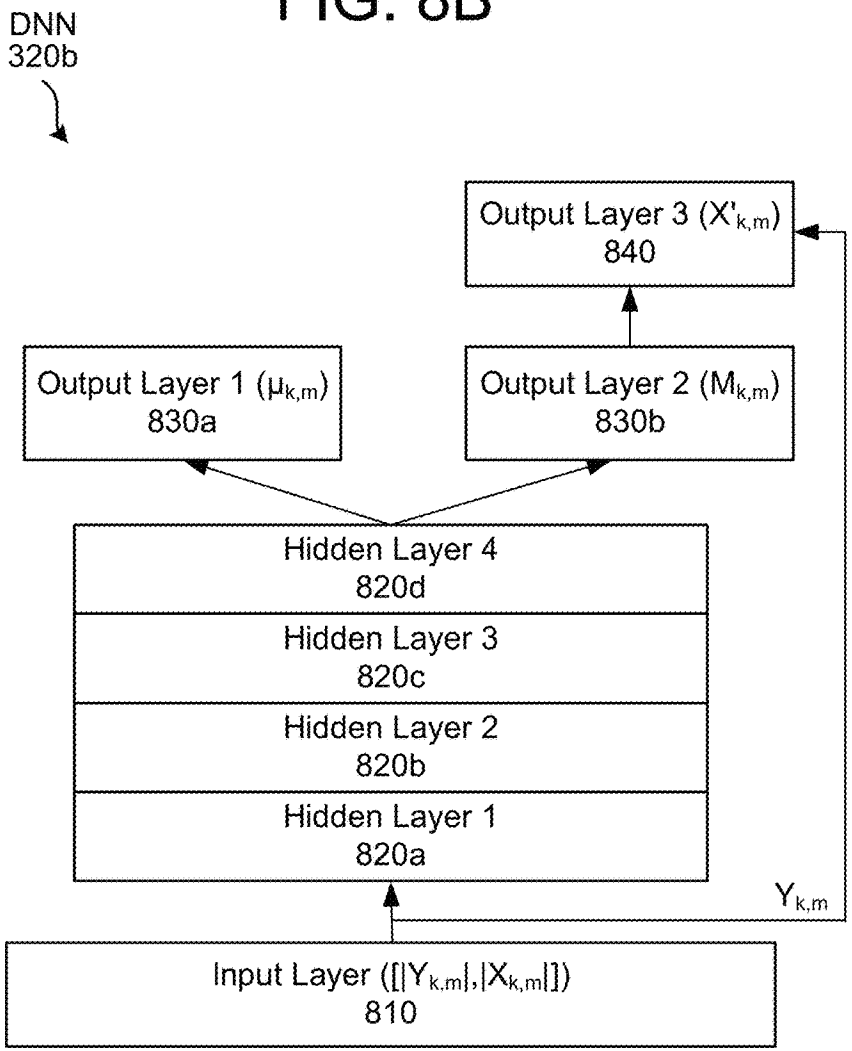
FIGS. 8A-8D illustrate example component diagrams of deep neutral network frameworks according to embodiments of the present disclosure.
Figure 8A:
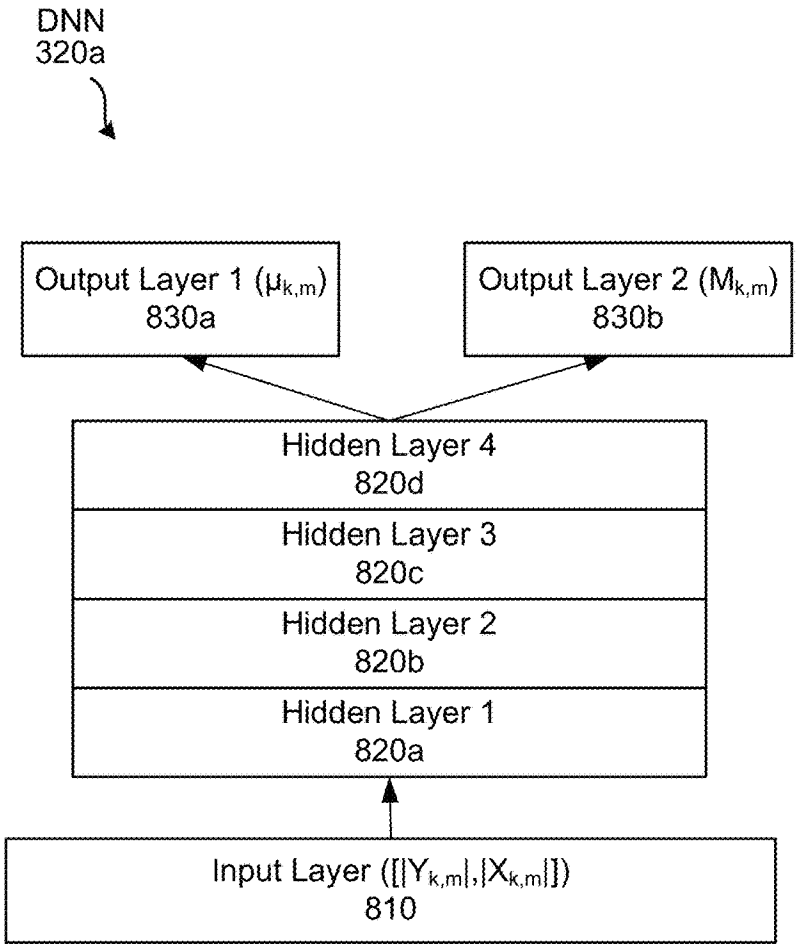

FIGS. 8A-8D illustrate example component diagrams of deep neutral network frameworks according to embodiments of the present disclosure. As illustrated in FIG. 8A, an example of a first DNN 320*a* may include an input layer 810 (e.g., $[|Y_{k,m}|, |X_{k,m}|]$), a series of hidden layers 820, and two output layers 830. For example, the first DNN 320*a* may include four hidden layers 820*a*-820*d*, a first output layer 830*a* configured to output step-size data $\mu_{k,m}$ and a second output layer 830*b* configured to output mask data $M_{k,m}$, although the disclosure is not limited thereto.

In some examples, instead of outputting the mask data $M_{k,m}$, the DNN 320 may output the reference signal $X'_{k,m}$. As illustrated in FIG. 8B, an example of a second DNN 320*b* may include a third output layer 840 configured to receive the mask data $M_{k,m}$ and the microphone data $Y_{k,m}$ as inputs and generate the reference signal $X'_{k,m}$, although the disclosure is not limited thereto.

Figure 8D:
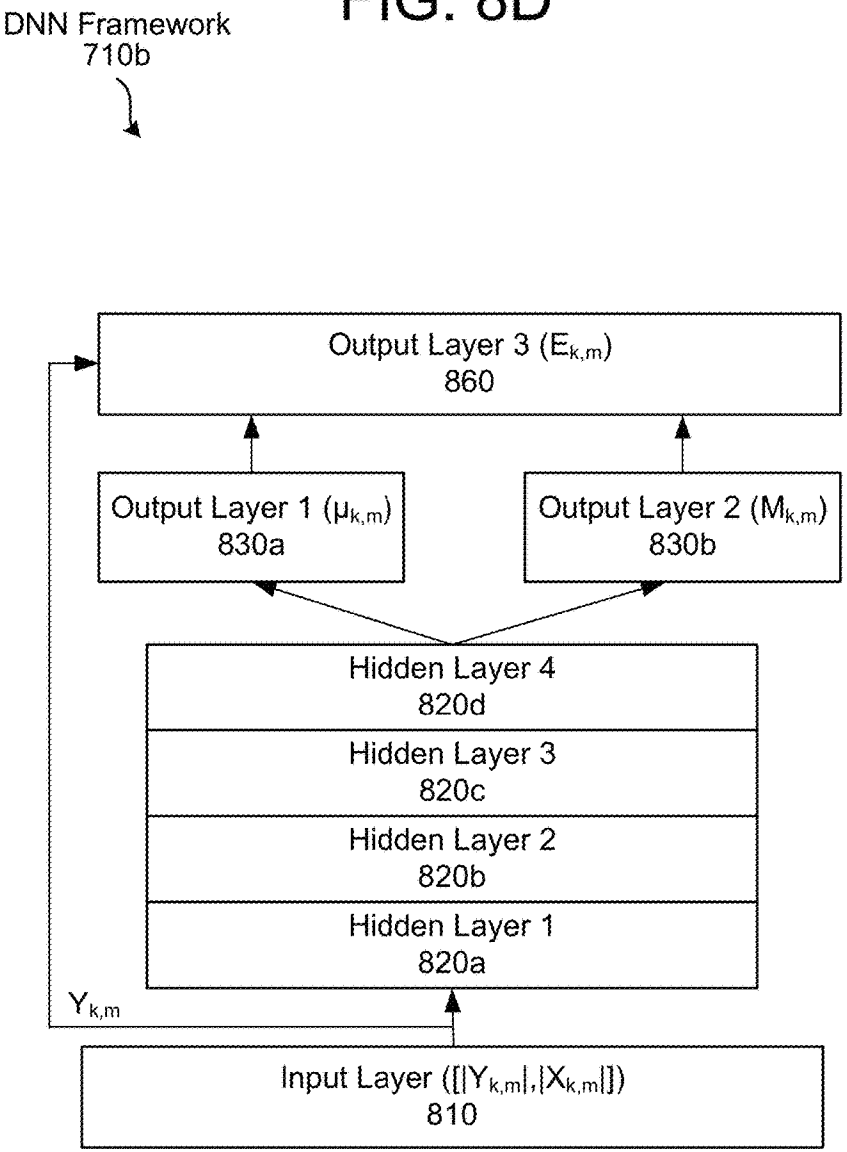
Figure 8C:
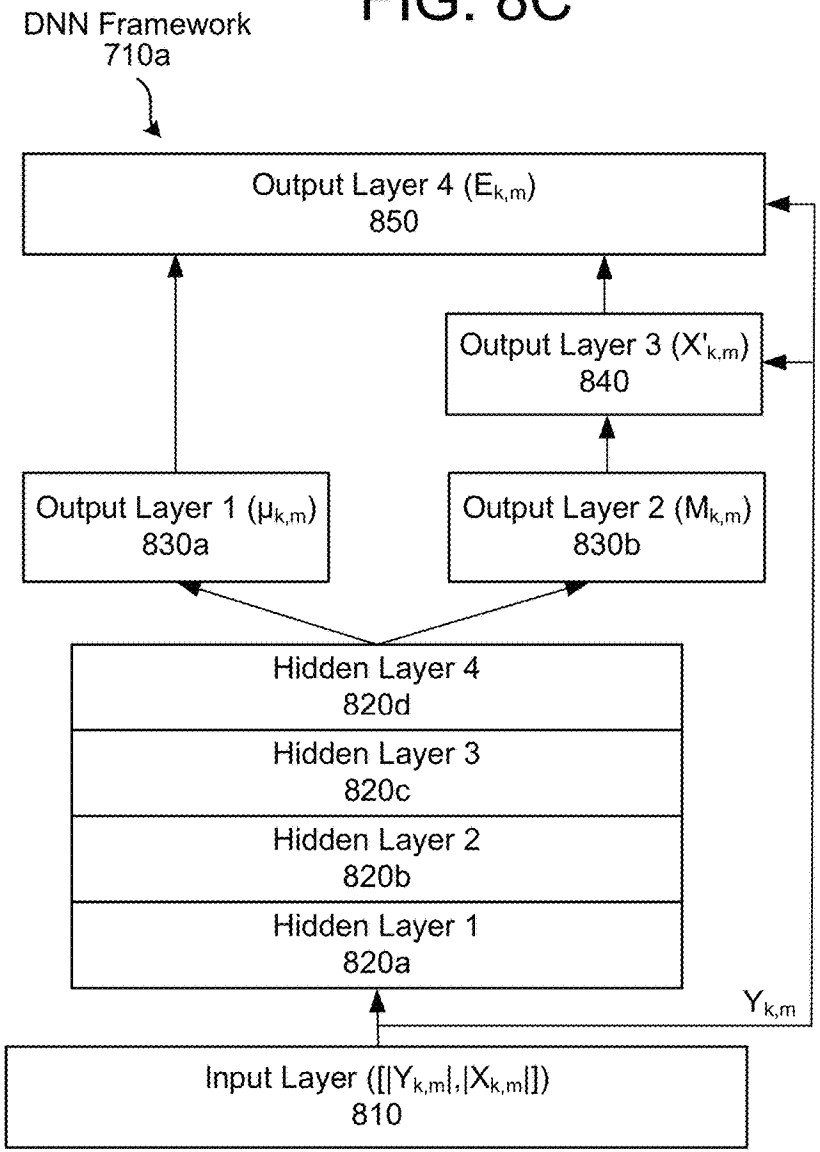

While FIGS. 8A-8B illustrate examples of the DNN 320, which is configured to generate outputs that are processed by the linear AEC component 330, FIGS. 8C-8D illustrate examples of the DNN framework 710 incorporating the linear AEC processing as a differentiable layer. As illustrated in FIG. 8C, an example of a first DNN framework 710*a* includes the third output layer 840 along with a fourth output layer 850 configured to receive the step-size data $\mu_{k,m}$, the microphone data $Y_{k,m}$, and the reference data $X'_{k,m}$ as inputs and generate the error signal $E_{k,m}$, although the disclosure is not limited thereto. For example, the fourth output layer 850 may generate the estimated echo signal $\hat{D}_{k,m}$, and then subtract the estimated echo signal $\hat{D}_{k,m}$ from the microphone data $Y_{k,m}$ to generate the generate the error signal $E_{k,m}$, although the disclosure is not limited thereto.

In some examples, the DNN framework 710 may not explicitly generate the reference $X'_{k,m}$. As illustrated in FIG. 8D, an example of a second DNN framework 710*b* inputs the mask data $M_{k,m}$ directly to the linear AEC layer to generate the error signal $E_{k,m}$. Thus, the second DNN framework 710*b* includes a third output layer 860 configured to receive the microphone data $Y_{k,m}$, the step-size data $\mu_{k,m}$, and the mask data $M_{k,m}$ as inputs and generate the error signal $E_{k,m}$, although the disclosure is not limited thereto. For example, the third output layer 860 may generate the estimated echo signal $\hat{D}_{k,m}$ and then subtract the estimated echo signal $\hat{D}_{k,m}$ from the microphone data $Y_{k,m}$ to generate the generate the error signal $E_{k,m}$, although the disclosure is not limited thereto.

While FIGS. 8A-8D illustrate several example implementations of the DNN 320 and/or the DNN framework 710, these are intended to conceptually illustrate a subset of examples and the disclosure is not limited thereto. Additionally or alternatively, while FIGS. 8B-8D illustrate examples of multiple output layers in series, the disclosure is not limited thereto and some of these output layers may correspond to hidden layers without departing from the disclosure. For example, the second output layer 830*b* illustrated in the second DNN 320*b* may be represented as a fifth hidden layer 820*e* without departing from the disclosure. Similarly, in the first DNN framework 710*a* illustrated in FIG. 8C, the first output layer 830*a*, the second output layer 830*b*, and the third output layer 840 may be represented as additional hidden layers 820*e*-820*g* without departing from the disclosure. Finally, in the second DNN framework 710*b* illustrated in FIG. 8D, the first output layer 830*a* and the second output layer 830*b* may be represented as hidden layers 820*e*-820*f* without departing from the disclosure.

Figure 9:
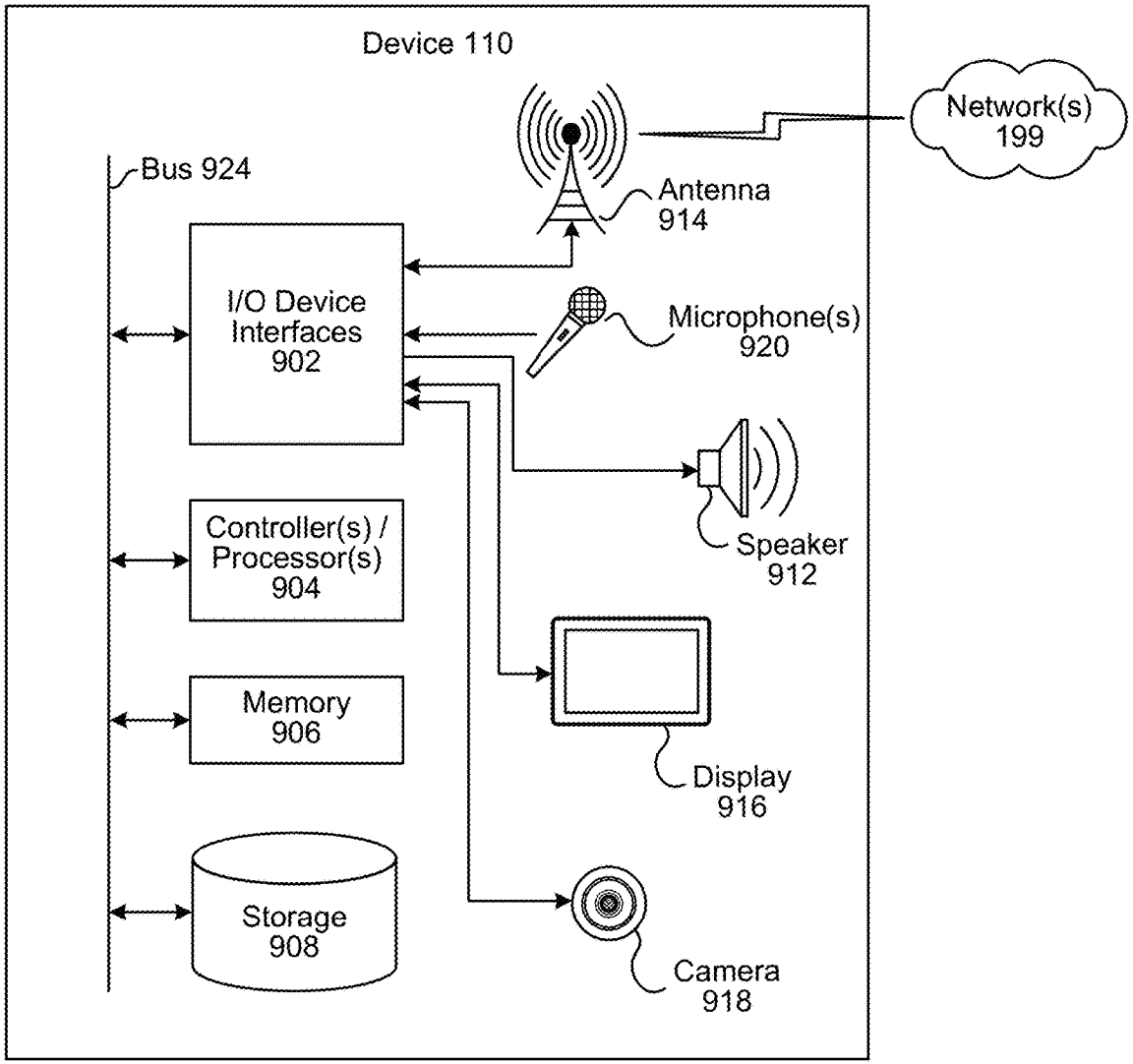
FIG. 9 is a block diagram conceptually illustrating example components of a device, according to embodiments of the present disclosure.
Figure 10:
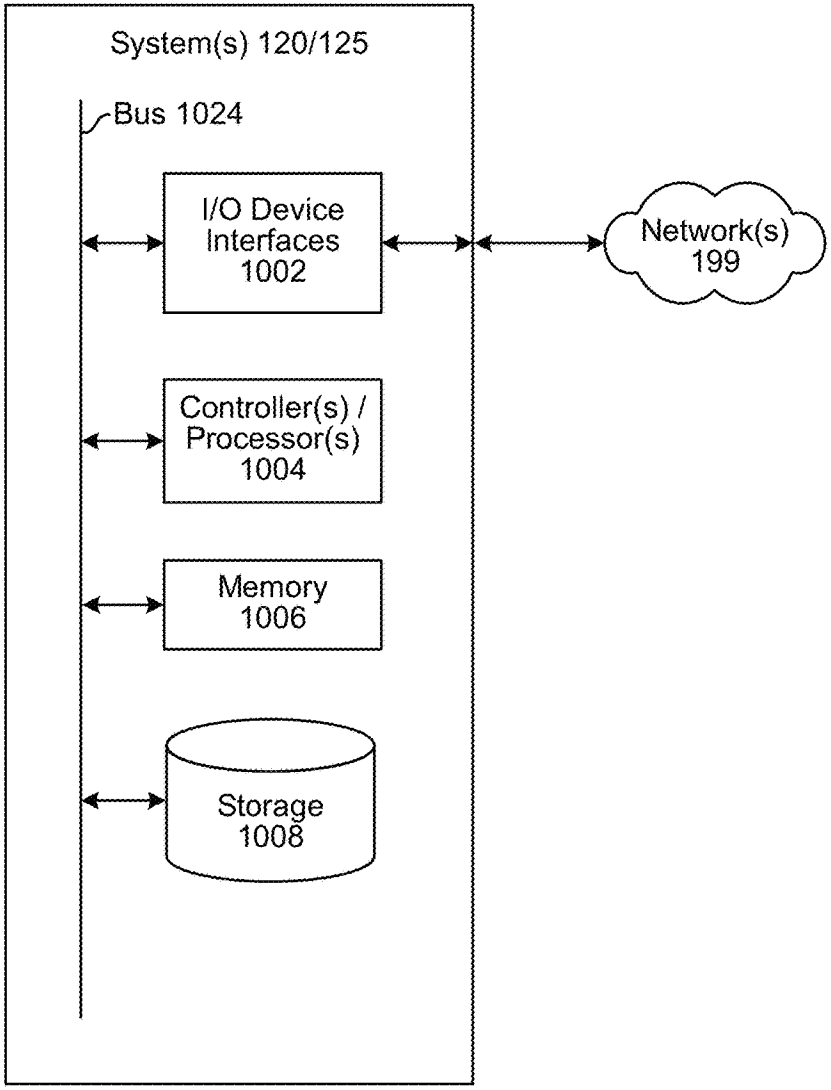
FIG. 10 is a block diagram conceptually illustrating example components of a system, according to embodiments of the present disclosure.

FIG. 9 is a block diagram conceptually illustrating a device 110 that may be used with the remote system 120. FIG. 10 is a block diagram conceptually illustrating example components of a remote device, such as the remote system 120, which may assist with ASR processing, NLU processing, etc.; and a skill component 125. A system (120/125) may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The remote system 120 may be configured to operate using one or more of a client-server model, a computer bureau model, grid computing techniques, fog computing techniques, mainframe techniques, utility computing techniques, a peer-to-peer model, sandbox techniques, or other computing techniques.

Multiple systems (120/125) may be included in the system 100 of the present disclosure, such as one or more remote systems 120 for performing ASR processing, one or more remote systems 120 for performing NLU processing, and one or more skill component 125, etc. In operation, each of these systems may include computer-readable and computer-executable instructions that reside on the respective device (120/125), as will be discussed further below.

Each of these devices (110/120/125) may include one or more controllers/processors (904/1004), which may each include a central processing unit (CPU) for processing data and computer-readable instructions, and a memory (906/1006) for storing data and instructions of the respective device. The memories (906/1006) may individually include volatile random access memory (RAM), non-volatile read only memory (ROM), non-volatile magnetoresistive memory (MRAM), and/or other types of memory. Each device (110/120/125) may also include a data storage component (908/1008) for storing data and controller/processor-executable instructions. Each data storage component (908/1008) may individually include one or more non-volatile storage types such as magnetic storage, optical storage, solid-state storage, etc. Each device (110/120/125) may also be connected to removable or external non-volatile memory and/or storage (such as a removable memory card, memory key drive, networked storage, etc.) through respective input/output device interfaces (902/1002).

Computer instructions for operating each device (110/120/125) and its various components may be executed by the respective device's controller(s)/processor(s) (904/1004), using the memory (906/1006) as temporary "working" storage at runtime. A device's computer instructions may be stored in a non-transitory manner in non-volatile memory (906/1006), storage (908/1008), or an external device(s). Alternatively, some or all of the executable instructions may be embedded in hardware or firmware on the respective device in addition to or instead of software.

Each device (110/120/125) includes input/output device interfaces (902/1002). A variety of components may be connected through the input/output device interfaces (902/1002), as will be discussed further below. Additionally, each device (110/120/125) may include an address/data bus (924/1024) for conveying data among components of the respective device. Each component within a device (110/120/125) may also be directly connected to other components in addition to (or instead of) being connected to other components across the bus (924/1024).

Referring to FIG. 9, the device 110 may include input/output device interfaces 902 that connect to a variety of components such as an audio output component such as a speaker 912, a wired headset or a wireless headset (not illustrated), or other component capable of outputting audio. The device 110 may also include an audio capture component. The audio capture component may be, for example, a microphone 920 or array of microphones, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 916 for displaying content. The device 110 may further include a camera 918.

Via antenna(s) 914, the input/output device interfaces 902 may connect to one or more networks 199 via a wireless local area network (WLAN) (such as Wi-Fi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (902/1002) may also include communication components that allow data to be exchanged between devices such as different physical servers in a collection of servers or other components.

The components of the device 110, the remote system 120, and/or a skill component 125 may include their own dedicated processors, memory, and/or storage. Alternatively, one or more of the components of the device 110, the remote system 120, and/or a skill component 125 may utilize the I/O interfaces (902/1002), processor(s) (904/1004), memory (906/1006), and/or storage (908/1008) of the device(s) 110, system 120, or the skill component 125, respectively.

As noted above, multiple devices may be employed in a single system. In such a multi-device system, each of the devices may include different components for performing different aspects of the system's processing. The multiple devices may include overlapping components. The components of the device 110, the remote system 120, and a skill component 125, as described herein, are illustrative, and may be located as a stand-alone device or may be included, in whole or in part, as a component of a larger device or system.

Figure 11:
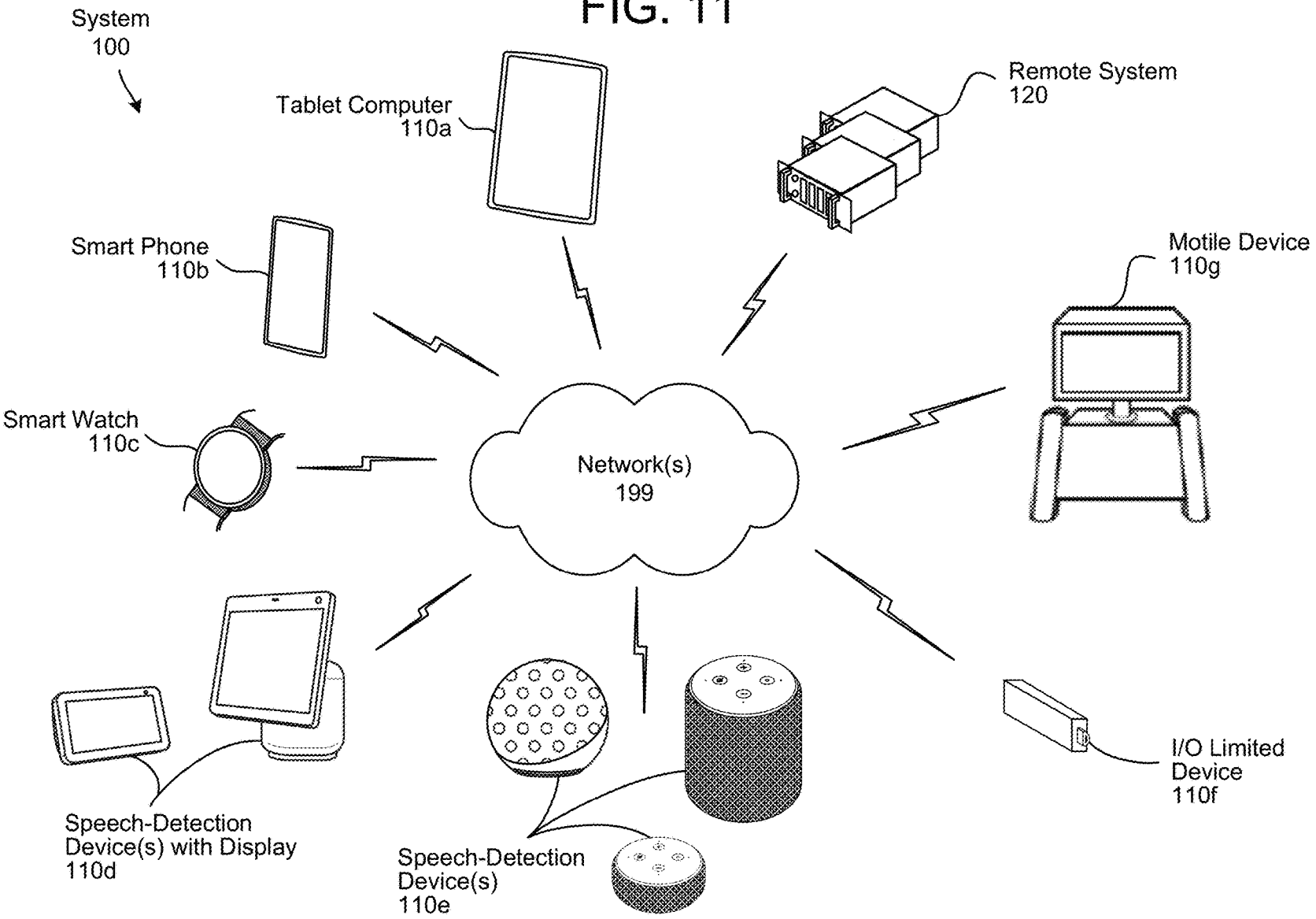
FIG. 11 illustrates an example of a computer network for use with the overall system, according to embodiments of the present disclosure.

As illustrated in FIG. 11, multiple devices (110*a*-110*g* and 120) may contain components of the system and the devices may be connected over a network(s) 199. The network(s) 199 may include a local or private network or may include a wide network such as the Internet. Devices may be connected to the network(s) 199 through either wired or wireless connections. As illustrated in FIG. 11, a tablet computer 110*a*, a smart phone 110*b*, a smart watch 110*c*, speech-detection device(s) with a display 110*d*, speech-detection device(s) 110*e*, input/output (I/O) limited device 110*f*, and/or a motile device 110*g* (e.g., device capable of autonomous motion) may be connected to the network(s) 199 through a wired and/or wireless connection. For example, the devices 110 may be connected to the network (s) 199 via an Ethernet port, through a wireless service provider (e.g., using a WiFi or cellular network connection), over a wireless local area network (WLAN) (e.g., using WiFi or the like), over a wired connection such as a local area network (LAN), and/or the like.

Other devices are included as network-connected support devices, such as the remote system 120 and/or other devices (not illustrated). The support devices may connect to the network(s) 199 through a wired connection or wireless connection. The devices 110 may capture audio using one-or-more built-in or connected microphones or other audio capture devices, with processing performed by ASR components, NLU components, or other components of the same device or another device connected via the network(s) 199, such as an ASR component, NLU component, etc. of the remote system 120.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware, such as an Audio Front End (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving playback audio data;

receiving microphone audio data representing captured audio, wherein a first portion of the captured audio corresponds to speech and a second portion of the captured audio corresponds to the playback audio data;

processing, using a first model, the playback audio data and the microphone audio data to generate first data and parameter data;

generating, using (i) an adaptive filter, (ii) the parameter data, and (iii) the first data, first audio data, wherein at least a portion of the first audio data corresponds to the second portion of the captured audio; and generating second audio data using the first audio data and the microphone audio data, wherein at least a portion of the second audio data corresponds to the first portion of the captured audio.

2. The computer-implemented method of claim 1, further comprising:

determining, using the first data, a first mask value corresponding to a first portion of the microphone audio data;

generating a first portion of third audio data by applying the first mask value to the first portion of the microphone audio data;

determining, using the first data, a second mask value corresponding to a second portion of the microphone audio data; and generating a second portion of the third audio data by applying the second mask value to the second portion of the microphone audio data, wherein the first audio data is generated using the third audio data.

3. The computer-implemented method of claim 1, wherein the first audio data corresponds to the second portion of the captured audio and a third portion of the captured audio that represents acoustic noise, and a first representation of the acoustic noise included in the second audio data is attenuated relative to a second representation of the acoustic noise included in the microphone audio data.

4. The computer-implemented method of claim 1, further comprising:

generating, using the first data and the microphone audio data, third audio data, wherein the first data represents a mask indicating portions of the microphone audio data that include representations of the second portion of the captured audio, and the first audio data is generated using the third audio data.

5. The computer-implemented method of claim 1, wherein the parameter data includes a first step-size value and a second step-size value, the first step-size value indicating that a first portion of the microphone audio data includes a representation of the speech, the second step-size value indicating that the speech is not represented in a second portion of the microphone audio data.

6. The computer-implemented method of claim 1, wherein generating the first audio data further comprises:

determining, using the parameter data, a first step-size value corresponding to a first portion of the first data;

generating, by the adaptive filter using the first portion of the first data and a first plurality of coefficient values, a first portion of the first audio data;

determining, by the adaptive filter using the first step-size value and the first portion of the first audio data, a second plurality of coefficient values; and generating, by the adaptive filter using a second portion of the first data and the second plurality of coefficient values, a second portion of the first audio data.

7. The computer-implemented method of claim 6, wherein generating the first audio data further comprises:

determining, using the parameter data, a second step-size value corresponding to the second portion of the first data, the second step-size value indicating that the second portion of the first data includes a representation of the speech; and generating, by the adaptive filter using a third portion of the first data and the second plurality of coefficient values, a third portion of the first audio data.

8. The computer-implemented method of claim 1, wherein processing the playback audio data and the microphone audio data further comprises:

determining, by the first model using a first portion of the playback audio data and a first portion of the microphone audio data, that the first portion of the microphone audio data includes a representation of the speech;

determining, by the first model, a first value of the parameter data corresponding to the first portion of the microphone audio data;

determining, by the first model using a second portion of the playback audio data and a second portion of the microphone audio data, that the speech is not represented in the second portion of the microphone audio data; and determining, by the first model, a second value of the parameter data corresponding to the second portion of the microphone audio data.

9. A system comprising:

at least one processor; and memory including instructions operable to be executed by the at least one processor to cause the system to:

receive playback audio data;

receive microphone audio data representing captured audio, wherein a first portion of the captured audio corresponds to speech and a second portion of the captured audio corresponds to the playback audio data;

process, using a first model, the playback audio data and the microphone audio data to generate first data and parameter data;

generate, using (i) an adaptive filter, (ii) the parameter data, and (iii) the first data, first audio data, wherein at least a portion of the first audio data corresponds to the second portion of the captured audio; and generate second audio data using the first audio data and the microphone audio data, wherein at least a portion of the second audio data corresponds to the first portion of the captured audio.

10. The system of claim 9, wherein the memory further comprises instructions that, when executed by the at least one processor, further cause the system to:

determine, using the first data, a first mask value corresponding to a first portion of the microphone audio data;

generate a first portion of third audio data by applying the first mask value to the first portion of the microphone audio data;

determine, using the first data, a second mask value corresponding to a second portion of the microphone audio data; and generate a second portion of the third audio data by applying the second mask value to the second portion of the microphone audio data, wherein the first audio data is generated using the third audio data.

11. The system of claim 9, wherein the first audio data corresponds to the second portion of the captured audio and a third portion of the captured audio that represents acoustic noise, and a first representation of the acoustic noise included in the second audio data is attenuated relative to a second representation of the acoustic noise included in the microphone audio data.

12. The system of claim 9, wherein the memory further comprises instructions that, when executed by the at least one processor, further cause the system to:

generate, using the first data and the microphone audio data, third audio data, wherein the first data represents a mask indicating portions of the microphone audio data that include representations of the second portion of the captured audio, and the first audio data is generated using the third audio data.

13. The system of claim 9, wherein the parameter data includes a first step-size value and a second step-size value, the first step-size value indicating that a first portion of the microphone audio data includes a representation of the speech, the second step-size value indicating that the speech is not represented in a second portion of the microphone audio data.

14. The system of claim 9, wherein the memory further comprises instructions that, when executed by the at least one processor, further cause the system to:

determine, using the parameter data, a first step-size value corresponding to a first portion of the first data;

generate, by the adaptive filter using the first portion of the first data and a first plurality of coefficient values, a first portion of the first audio data;

determine, by the adaptive filter using the first step-size value and the first portion of the first audio data, a second plurality of coefficient values; and generate, by the adaptive filter using a second portion of the first data and the second plurality of coefficient values, a second portion of the first audio data.

15. The system of claim 14, wherein the memory further comprises instructions that, when executed by the at least one processor, further cause the system to:

determine, using the parameter data, a second step-size value corresponding to the second portion of the first data, the second step-size value indicating that the second portion of the first data includes a representation of the speech; and generate, by the adaptive filter using a third portion of the first data and the second plurality of coefficient values, a third portion of the first audio data.

16. The system of claim 9, wherein the memory further comprises instructions that, when executed by the at least one processor, further cause the system to:

determine, by the first model using a first portion of the playback audio data and a first portion of the microphone audio data, that the first portion of the microphone audio data includes a representation of the speech;

determine, by the first model, a first value of the parameter data corresponding to the first portion of the microphone audio data;

determine, by the first model using a second portion of the playback audio data and a second portion of the microphone audio data, that the speech is not represented in the second portion of the microphone audio data; and determine, by the first model, a second value of the parameter data corresponding to the second portion of the microphone audio data.

17. A computer-implemented method, the method comprising:

receiving playback audio data;

receiving microphone audio data representing captured audio, wherein a first portion of the captured audio corresponds to speech and a second portion of the captured audio corresponds to the playback audio data;

processing, using a first model, the playback audio data and the microphone audio data to generate mask data and step-size data;

generating first audio data using the microphone audio data and the mask data, wherein at least a portion of the first audio data corresponds to the second portion of the captured audio;

generating, using (i) an adaptive filter, (ii) the step-size data, and (iii) the first audio data, second audio data; and generating third audio data using the second audio data and the microphone audio data, wherein at least a portion of the third audio data corresponds to the first portion of the captured audio.

18. The computer-implemented method of claim 17, wherein generating the first audio data further comprises:

determining, using the mask data, a first mask value corresponding to a first portion of the microphone audio data;

generating a first portion of the first audio data by applying the first mask value to the first portion of the microphone audio data;

determining, using the mask data, a second mask value corresponding to a second portion of the microphone audio data; and generating a second portion of the first audio data by applying the second mask value to the second portion of the microphone audio data.

19. The computer-implemented method of claim 17, wherein the first audio data corresponds to the second portion of the captured audio and a third portion of the captured audio that represents acoustic noise, and a first representation of the acoustic noise included in the third audio data is attenuated relative to a second representation of the acoustic noise included in the microphone audio data.

20. The computer-implemented method of claim 17, wherein processing the playback audio data and the microphone audio data further comprises:

determining, by the first model using a first portion of the playback audio data and a first portion of the microphone audio data, that the first portion of the microphone audio data includes a representation of the speech;

determining, by the first model, a first value of the step-size data corresponding to the first portion of the microphone audio data;

determining, by the first model using a second portion of the playback audio data and a second portion of the microphone audio data, that the speech is not represented in the second portion of the microphone audio data; and determining, by the first model, a second value of the step-size data corresponding to the second portion of the microphone audio data.

* * * * *